US008191188B2

(12) United States Patent
Kaplan et al.

(10) Patent No.: US 8,191,188 B2
(45) Date of Patent: Jun. 5, 2012

(54) SWADDLE BLANKET

(75) Inventors: Joel Kaplan, New York, NY (US); Alvin Kaplan, Armonk, NY (US); Richard White, Dayton, OH (US); Deborah Ashworth, Tipp City, OH (US); Jonathan Daugherty, Clayton, OH (US)

(73) Assignee: Triboro Quilt Manufacturing Corporation, White Plains, NY (US)

( * ) Notice: Subject to any disclaimer, the term of this patent is extended or adjusted under 35 U.S.C. 154(b) by 373 days.

(21) Appl. No.: 12/434,433

(22) Filed: May 1, 2009

(65) Prior Publication Data

US 2010/0275373 A1 Nov. 4, 2010

(51) Int. Cl.
*A47G 9/04* (2006.01)
*A41B 13/06* (2006.01)
*A61F 5/37* (2006.01)

(52) U.S. Cl. ..... 5/485; 5/482; 5/494; 5/655; 5/923; 2/69.5

(58) Field of Classification Search ..... 5/482, 485, 5/494, 655, 413 R, 922, 923; 2/69, 69.5
See application file for complete search history.

(56) References Cited

U.S. PATENT DOCUMENTS 429,894 A 6/1890 Doremus
648,621 A 5/1900 Hopper et al.
857,507 A 6/1907 Wilson
1,474,738 A 11/1923 Thierjung
1,584,853 A * 5/1926 Dern ..... 2/69
1,897,521 A 2/1933 LaGarde
1,964,271 A 6/1934 O'Dwyer
2,227,751 A 1/1941 Idelman
2,342,069 A 2/1944 Wilkinson
2,423,392 A 7/1947 Krogh
2,440,891 A 5/1948 Bockhold (Continued)

FOREIGN PATENT DOCUMENTS

FR 2730617 A 8/1996

(Continued)

OTHER PUBLICATIONS

JP Patent Application No. 2003-569004: Office Action, Dated Oct. 18, 2011.

*Primary Examiner* — Robert G Santos
(74) *Attorney, Agent, or Firm* — McDermott Will & Emery LLP

(57) ABSTRACT

A swaddle blanket and mattress attachment device. The swaddle blanket includes a top end and a bottom end with a pocket disposed at the bottom end and configured to enclose an infants legs. A first side of the blanket is configured to wrap over the infant in one direction and a second side of the blanket is configured to wrap over the infant and the first side in the other direction. A fastener is disposed on the second side of the blanket and is configured to secure the second side in place over the first side. At least one attachment strap is secured to the swaddle blanket. When the blanket is in an attachment position the attachment strap extends away from the swaddle blanket. The attachment strap including a first mating pair fastener. The mattress attachment device is configured to be secured to a sleeping surface. The mattress attachment device includes at least one second mating pair fastener that is securable to the first mating pair fastener.

15 Claims, 37 Drawing Sheets

U.S. PATENT DOCUMENTS

| | | | | |
|---|---|---|---|---|
| 2,450,923 | A | 10/1948 | Spiro, Jr. | |
| 2,481,741 | A | 9/1949 | Graves | |
| 2,503,427 | A | 4/1950 | Waterworth | |
| 2,563,501 | A | 8/1951 | Sperling | |
| 2,596,547 | A | 5/1952 | Guest | |
| 2,677,834 | A | 5/1954 | Moynihan | |
| 2,693,177 | A | 11/1954 | Barstow | |
| 2,702,385 | A | 2/1955 | Goldberg | |
| 2,940,443 | A | 6/1960 | Baker | |
| 2,989,753 | A * | 6/1961 | Burner | 2/69.5 |
| 3,034,132 | A | 5/1962 | Landsberger et al. | |
| 3,521,309 | A | 7/1970 | Evans | |
| 3,739,399 | A | 6/1973 | Sheahon | |
| 3,845,513 | A | 11/1974 | Hubner et al. | |
| 3,848,281 | A | 11/1974 | Mathews | |
| 3,854,156 | A | 12/1974 | Williams | |
| 3,987,505 | A | 10/1976 | Hickey | |
| 4,172,300 | A | 10/1979 | Miller | |
| 4,199,830 | A | 4/1980 | Ogata et al. | |
| 4,202,052 | A | 5/1980 | Bilanzich | |
| 4,445,242 | A | 5/1984 | Bowen | |
| 4,597,121 | A | 7/1986 | Bouma | |
| 4,627,363 | A | 12/1986 | Jones | |
| 4,653,131 | A | 3/1987 | Diehl | |
| 4,688,282 | A | 8/1987 | Jeffries | |
| 4,783,866 | A | 11/1988 | Simmons et al. | |
| 4,839,934 | A | 6/1989 | Rojas | |
| 4,858,259 | A | 8/1989 | Simmons et al. | |
| 4,858,625 | A | 8/1989 | Cramer | |
| 4,878,258 | A | 11/1989 | Casey | |
| 4,887,326 | A | 12/1989 | O'Brien et al. | |
| 4,897,885 | A | 2/1990 | Lunt | |
| 4,937,904 | A | 7/1990 | Ross | |
| 5,046,204 | A | 9/1991 | Mohler | |
| 5,084,929 | A | 2/1992 | Staudinger | |
| 5,131,096 | A * | 7/1992 | Olson | 2/75 |
| 5,148,560 | A | 9/1992 | Torres | |
| 5,168,590 | A | 12/1992 | O'Sullivan | |
| 5,243,724 | A | 9/1993 | Barnes | |
| 5,297,304 | A | 3/1994 | O'Sullivan | |
| 5,367,731 | A | 11/1994 | O'Sullivan | |
| D355,068 | S | 2/1995 | Prendergast | |
| 5,400,803 | A | 3/1995 | Vines | |
| 5,439,008 | A | 8/1995 | Bowman | |
| 5,488,746 | A | 2/1996 | Hudson | |
| 5,557,817 | A | 9/1996 | Haddock | |
| 5,572,757 | A | 11/1996 | O'Sullivan | |
| 5,722,094 | A | 3/1998 | Ruefer | |
| 5,746,219 | A | 5/1998 | McConnell | |
| 5,852,827 | A | 12/1998 | Lear | |
| 5,950,261 | A | 9/1999 | Hay et al. | |
| 5,996,147 | A | 12/1999 | Trimble | |
| 6,009,576 | A | 1/2000 | Gramme et al. | |
| 6,052,850 | A | 4/2000 | Salido et al. | |
| 6,105,168 | A | 8/2000 | Hazen | |
| 6,243,896 | B1 | 6/2001 | Osuna et al. | |
| 6,266,832 | B1 | 7/2001 | Ezell | |
| 6,286,163 | B1 | 9/2001 | Trimble | |
| 6,301,729 | B1 | 10/2001 | Hall et al. | |
| 6,341,397 | B1 * | 1/2002 | Kliegl et al. | 5/482 |
| 6,415,442 | B1 | 7/2002 | Smith | |
| 6,499,165 | B1 | 12/2002 | Morgillo et al. | |
| D468,951 | S | 1/2003 | Harris | |
| 6,631,528 | B2 | 10/2003 | Landry | |
| 6,640,340 | B2 * | 11/2003 | Gibson | 2/69.5 |
| 6,662,390 | B1 | 12/2003 | Berger | |
| 6,681,422 | B2 | 1/2004 | Landry | |
| 6,817,048 | B1 | 11/2004 | LaRosa | |
| 6,848,131 | B1 | 2/2005 | Landry | |
| 6,857,146 | B2 | 2/2005 | Landry | |
| 6,868,566 | B2 | 3/2005 | Gatten | |
| 6,928,674 | B2 * | 8/2005 | Blackburn | 5/482 |
| 7,043,783 | B2 | 5/2006 | Gatten | |
| 7,111,344 | B2 | 9/2006 | French et al. | |
| 7,150,054 | B1 | 12/2006 | Byrne et al. | |
| 7,181,789 | B2 | 2/2007 | Gatten | |
| 7,254,849 | B1 * | 8/2007 | Fiebrich et al. | 5/482 |
| 7,337,482 | B2 | 3/2008 | Byrne et al. | |
| 7,370,377 | B2 | 5/2008 | Landry | |
| 2003/0131411 | A1 * | 7/2003 | Gibson | 5/482 |
| 2003/0154548 | A1 | 8/2003 | Landry | |
| 2003/0154549 | A1 | 8/2003 | Landry | |
| 2004/0019969 | A1 | 2/2004 | Gatten | |
| 2004/0019970 | A1 | 2/2004 | Landry | |
| 2004/0139527 | A1 | 7/2004 | Damir et al. | |
| 2004/0199999 | A1 | 10/2004 | Landry | |
| 2004/0216230 | A1 * | 11/2004 | Blackburn | 5/482 |
| 2005/0028278 | A1 | 2/2005 | Landry | |
| 2005/0125895 | A1 | 6/2005 | Gatten | |
| 2006/0150330 | A1 | 7/2006 | Gatten | |
| 2007/0061968 | A1 | 3/2007 | Fader | |
| 2007/0094795 | A1 | 5/2007 | Byrne et al. | |
| 2010/0275373 | A1 * | 11/2010 | Kaplan et al. | 5/494 |
| 2011/0231993 | A1 * | 9/2011 | Schmid et al. | 5/494 |

FOREIGN PATENT DOCUMENTS

| | | | |
|---|---|---|---|
| GB | 927094 | | 5/1963 |
| GB | 2281510 | A | 3/1995 |
| JP | 60-164980 | U | 11/1985 |
| JP | 2-46846 | A | 2/1990 |
| JP | 5-72265 | U | 10/1993 |
| JP | 6-33577 | U | 5/1994 |
| JP | 3057370 | U | 5/1999 |
| JP | 2008-255533 | A | 10/2008 |
| WO | WO-9317606 | | 9/1993 |

* cited by examiner

222

222

SWADDLE BLANKET

BACKGROUND OF THE INVENTION

1. Field of the Invention

The present invention relates to sheets and blankets for an infant's crib or bed, and more particularly to a sheet and swaddle blanket combination for securing an infant on a sleep surface.

2. Description of Related Art

There are a variety of infant blankets and coverings for infants present in the art. In the past many designs functioned only to keep an infant warm while sleeping. Today much more is known about infant sleeping patterns and sleeping safety. The concern for infant warmth is now shared with the concern for infant comfort and safety. Some infants frequently change positions while sleeping, so it is desirable to make an infant's sleeping environment as free as possible of suffocation hazards while at the same time insuring the infant is kept in a secure sleeping position.

An additional consideration in infant bedding design is Sudden Infant Death Syndrome (SIDS) in which an apparently healthy infant will expire in a crib for no apparent reason. While the causes of SIDS still remain somewhat a mystery it is thought that sleeping in the prone position may increase the likelihood of SIDS. A device to maintain an infant in the supine position while sleeping is therefore desirable.

U.S. Pat. No. 2,677,834 discloses a crib blanket which is secured to the side of a crib with snap together fasteners. The blanket also contains a single strap along the blanket's upper margin for securing an infant to the blanket. This invention will keep a blanket secure in its relation to the crib but, unlike the present invention, uses only a single strap to secure the infant under the blanket. Further, the blanket is not attached to the crib sheet.

Other designs, such as U.S. Pat. Nos. 3,845,513 and 4,202,052, each disclose fitted garments which are sewn to crib sheets to restrict the movements of infants. The '513 patent shows a sleeping bag blanket secured to a bed linen sheet, the baby being secured in the sleeping bag by a diaper retainer with button down flaps and by a pull down zipper. The '052 patent shows a sheet with a central pleat having an opening defined therein to which a jacket may be attached, the jacket being secured around the infant by what appear to be button or snap fasteners. No blanket is shown. Infants must be manipulated to be secured in these garment-type inventions, which often wakes the infant as he or she is being put to bed, a highly undesirable side effect.

U.S. Pat. No. 6,301,729 discloses one bedding device designed to prevent SIDS. It is a pocket like blanket device which secures an infant between one edge of the pocket and a mattress. This bedding device does not secure an infant in the same manner as the present invention however.

Several other related devices are shown in the related references of U.S. Pat. Nos. Des. 355,068; 429,894; 857,507; U.S. Pat. Nos. 1,964,271; 2,277,751; 2,342,069; 2,423,392; 2,481,741; 2,503,427; 2,563,501; 2,596,547; 2,702,385; 3,034,132; 3,521,309; 3,739,399; 3,845,513; 3,848,281; 3,854,156; 3,987,505: 4,199,830; 4,172,300; 4,445,242; 4,597,121; 4,627,363; 4,688,282; 4,783,866; 4,839,934; 4,858,259; 4,878,258; 4,887,326; 4,897,885; 4,937,904; 5,046,204; 5,084,929; 5,148,560; 5,168,590; 5,243,724; 5,297,304; 5,367,731; 5,400,803; 5,439,008; 5,488,746; 5,557,817; 5,572,757; 5,722,094; 5,722,084; 5,852,827; 5,950,261; 5,996,147; 6,009,576; 6,052,850; 6,105,168; 6,243,896; 6,266,832; 6,286,163; 6,301,729; 6,415,442; 6,499,165; 6,631,528; 6,662,390; 6,681,422; 6,817,048; 6,848,131; 6,857,146; 6,868,566; 7,043,783; 7,150,054; 7,181,789; 7,337,482; 7,370,377; U.S. Patent Application Serial No. 2007/0061968; W.I.P.O. Patent Document No. WO93/17606; Switzerland Patent Document No. CH 658177; Great Britain Patent Document No. GB 927094; and an article entitled "Self-Adhering Nylon Tapes" in the Journal of AMA, Oct. 18, 1958. Each of these related references have been considered with respect to one or more of the related cases of the inventor, as submitted in the aforementioned cross-referenced applications.

Therefore, it is desirable to have an infant bedding product which will function to keep an infant covered and warm, is as free as possible of suffocation hazards, is easy to use, is adjustable and will prevent an infant from moving into the prone sleeping position while still permitting some infant movement.

None of the above inventions and patents, taken either singly or in combination, is seen to describe the instant invention as claimed.

SUMMARY OF THE INVENTION

In an embodiment, the present invention provides a swaddle blanket for an infant and a combination of a swaddle blanket and mattress attachment device. The swaddle blanket includes a top end and a bottom end with a pocket disposed at the bottom end and configured to enclose the infants legs. A first side of the blanket is configured to wrap over the infant in one direction and a second side of the blanket is configured to wrap over the infant and the first side in the other direction. A fastener is disposed on the second side of the blanket and is configured to secure the second side in place over the first side. At least one attachment strap is secured to the swaddle blanket. When the blanket is in an attachment position the attachment strap extends away from the swaddle blanket. The attachment strap including a first mating pair fastener. The mattress attachment device is configured to be secured to a sleeping surface. The mattress attachment device includes at least one second mating pair fastener that is securable to the first mating pair fastener.

These features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF PREFERRED EMBODIMENTS

Figure 1:
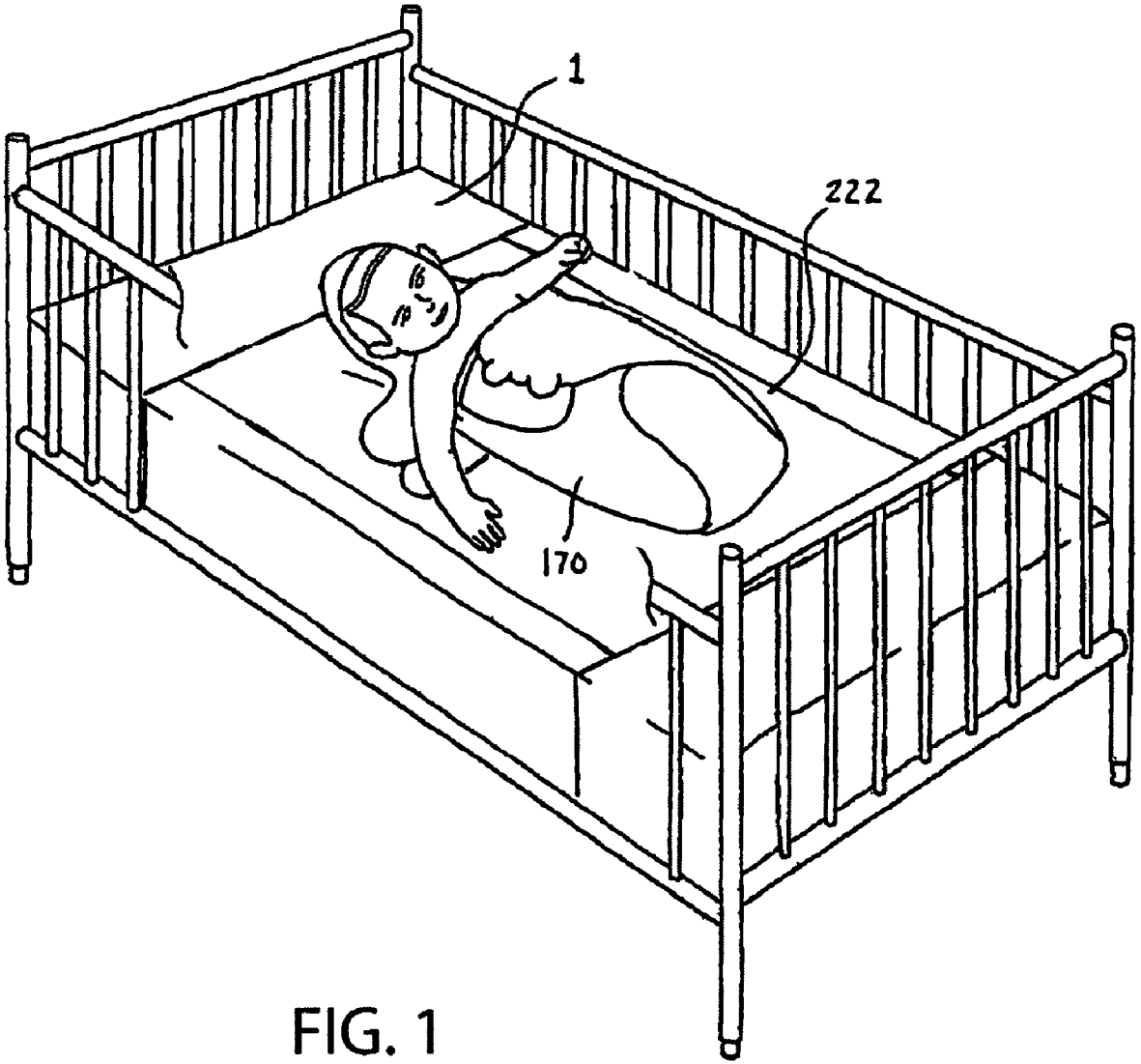
FIG. 1 is a perspective view of a swaddle blanket and mattress attachment device in accordance with an embodiment of the invention with an infant secured in the blanket.
Figure 2:
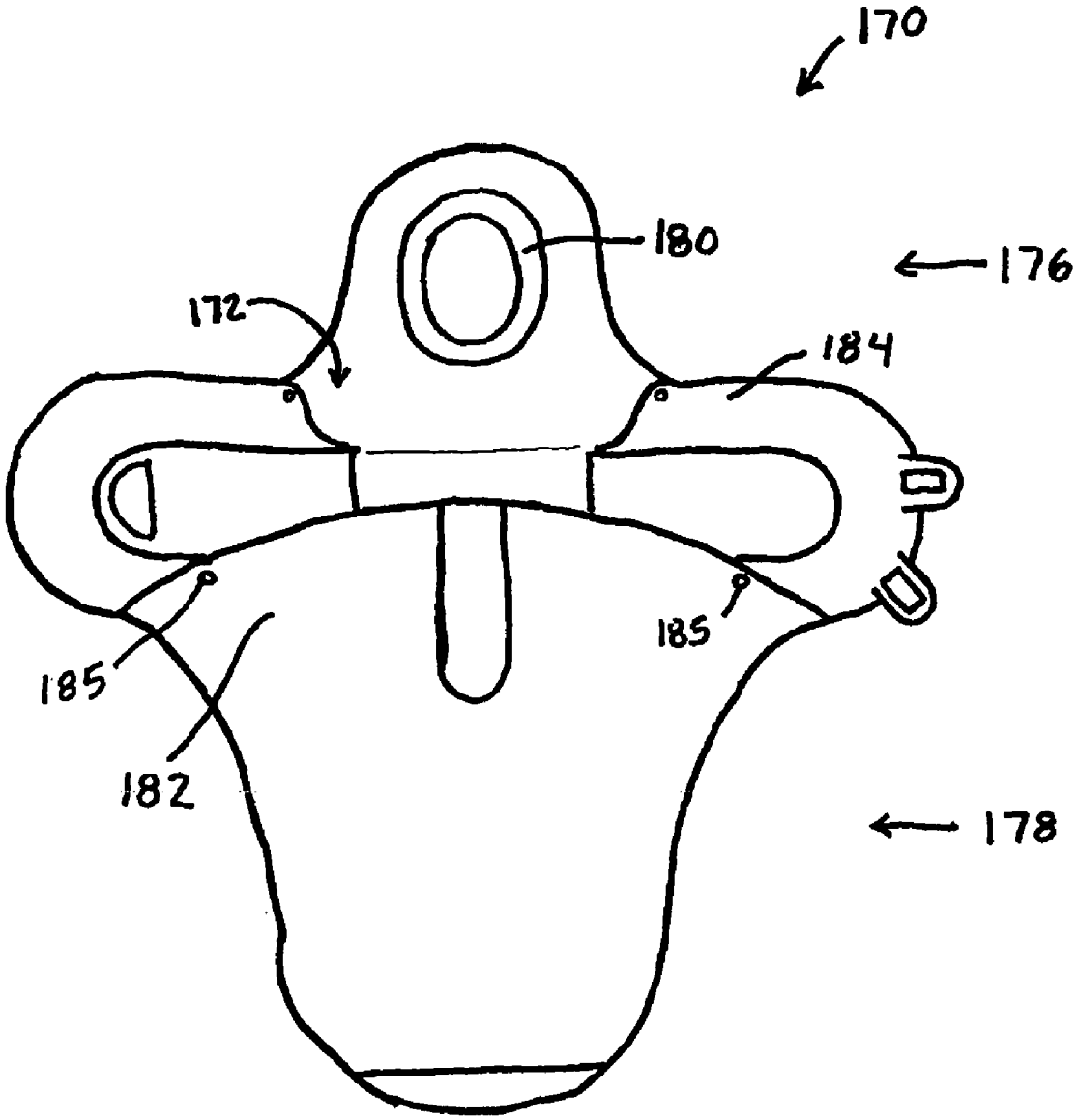
FIG. 2 is a top view of a swaddle blanket in accordance with an embodiment of the invention.

An embodiment of the present invention including a secure infant swaddle blanket 170 and a mattress attachment device 222 is shown in FIG. 1. Additional views of the swaddle blanket 170 of FIG. 1 are shown in FIGS. 2-9 as discussed in the following. In FIG. 2 the swaddle blanket 170 is shown in an open and laid out flat position, with only a front surface 172 of the swaddle blanket 170 viewable. At a top end 176 of the blanket 170, a head rest 180 is provided which is configured to hold an infants head when it is placed in the blanket. The head rest 180 may have a donut shape, as shown, or may have another shape, such as a triangle, square, trapezoid, pentagon, hexagon, octagon or pair of separated lines, resembling an equal sign. The donut shape of the head rest 180 allows the infant to be placed accurately on the swaddle blanket 170, thus providing a target for proper positioning of the infant within the swaddle blanket 170. Moreover, the head rest 180 reduces stress on the back of the infant's head, thereby reducing the likelihood of the infant's head being flattened (known as plagiocephaly). The head rest 180 may be formed of a soft and supportive material. For example, the head rest 180 could include a fabric material filled with stuffing, or a foam core. Other exemplary materials that may be used with the head rest include a polyester fiber fill, feathers, laytex, silicone, and other suitable filling materials.

Figure 3:
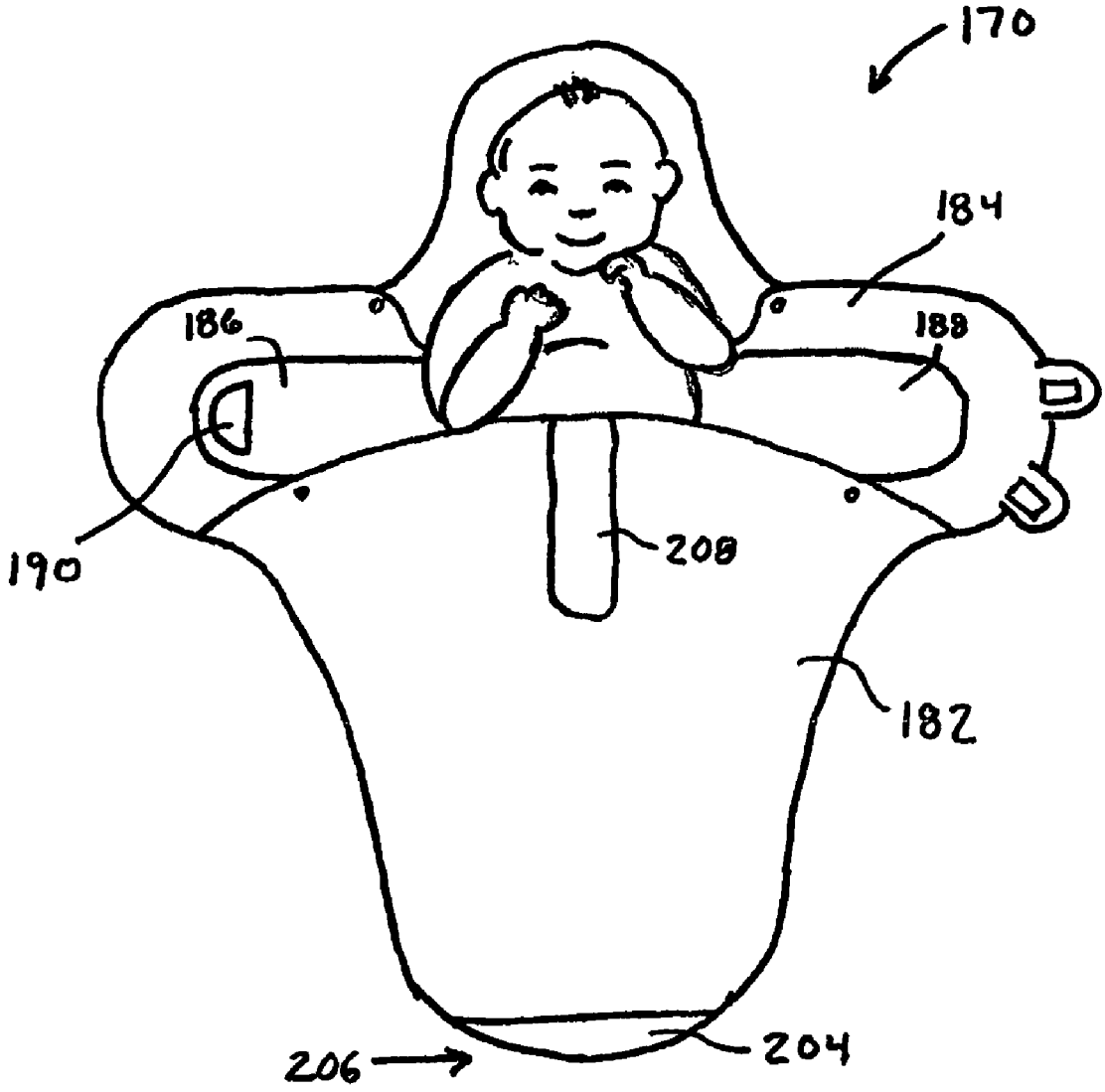
FIG. 3 is a top view of a swaddle blanket in use in one position.

A pocket 182 is included at a bottom end 178 of the swaddle blanket 170. The pocket 182 is configured to hold the infants legs when the infant is swaddled in the blanket. The pocket 182 may be formed from a second piece of textile material placed on the front surface 172 of a first piece of textile material that makes up the body 184 of the swaddle blanket. The second piece of textile material may then be attached around its side and lower edges to the first piece of textile material, for example by sewing, thermal bonding or with an adhesive. Alternatively, the body 184 of the swaddle blanket 170 and the pocket 182 may be made of a single piece of textile material, with the pocket 182 being formed of an extended portion of the textile material which is folded over and then attached to the front surface 172 of the body 184. For example, the extended portion could extend downward, and be folded upward and attached on both of its sides to form the pocket 182. In addition, the extended portion could extend to a side of the body 184 and be attached at the bottom and on the opposite side to form the pocket 182. In order to insert the infant into the pocket 182, as shown in FIG. 3, the top of the pocket 182 can be folded down for easier access to the inside of the pocket. In order to secure the pocket 182 over the infant, fasteners 185 can be included on either or both sides of the pocket 182. When the fasteners 185 are closed, the pocket remains in an upright position over the infant. As an example, the fasteners 185 may be snaps.

Figure 4:
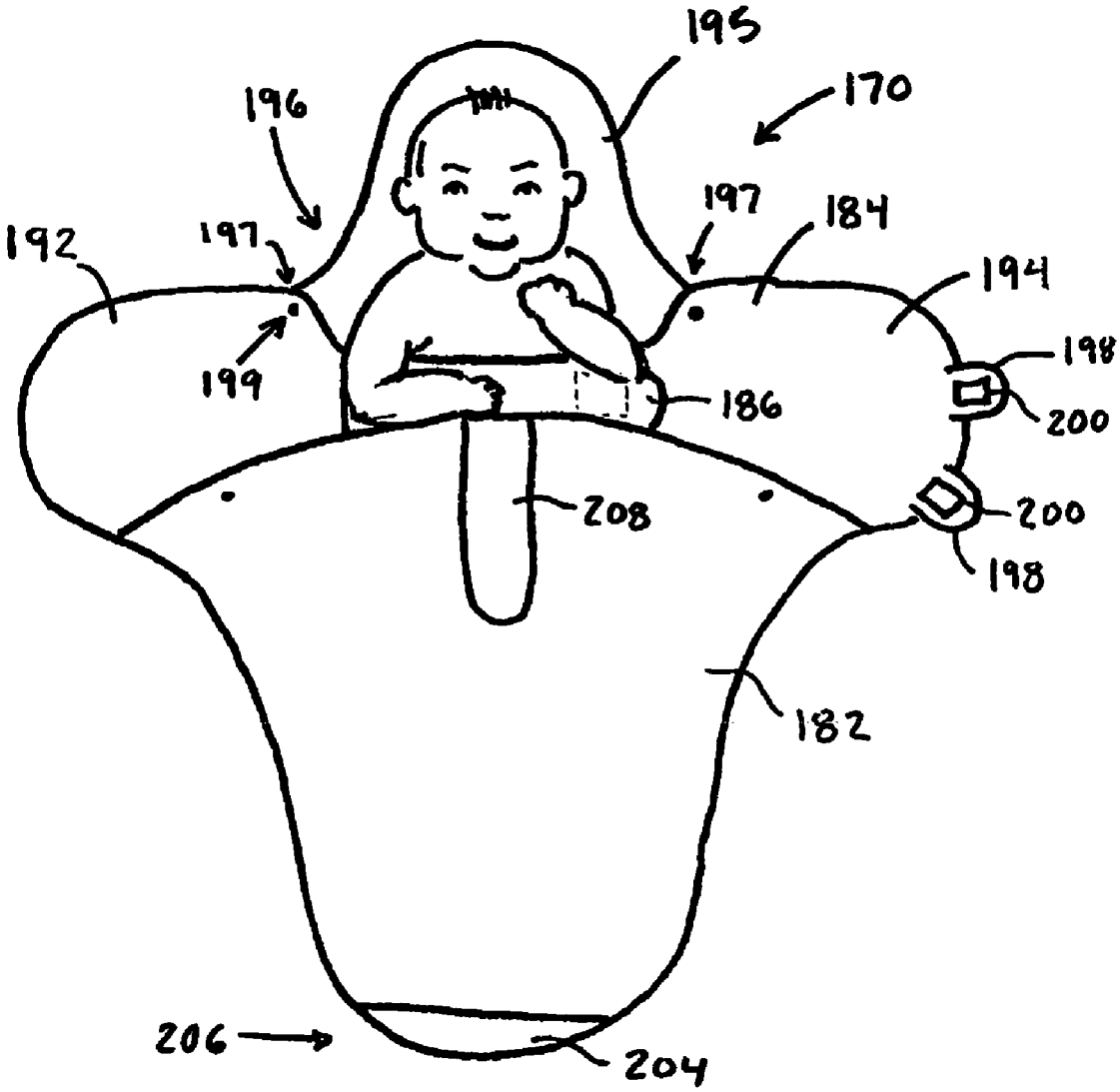
FIG. 4 is a top view of a swaddle blanket in use in another position.

FIG. 3 shows an infant placed on the swaddle blanket 170 with his head positioned on the headrest 180 and his legs positioned inside the pocket 182. In operation, after the infant is placed in this position, left and right inner straps 186, 188 are wrapped around the infant to hold him firmly in place with respect to the swaddle blanket 170, as shown in FIG. 4. The inner straps 186, 188 may be configured, as shown in FIG. 4, to be wrapped around the infants torso with the infants arms free of the inner straps. The inner straps help secure proper stability of the infant within the swaddle blanket and ensure that the infant cannot slide down into the wrapped up swaddle blanket. When combined with the head rest 180, these elements all help to position the infant in a desired location within the swaddle blanket. In the depicted embodiment, there are two inner straps 186 and 188 which each wrap around the infants torso. A front side of the left strap 186 includes a first strap fastener 190 (shown in FIG. 3) and a back side of the right strap 188 includes a second strap fastener. The corresponding first and second fasteners may be formed of hook and loop material. In addition to left and right inner straps 186 and 188, the swaddle blanket 170 may also include inner shoulder straps to provide increased security of the infant. In an alternative embodiment to that which is shown, a single inner strap may be included. The single inner strap may extend from one side of the infant, be wrapped over the infant, and be attached to the front side 172 of the blanket on the other side of the infant. The attached side of the inner strap, or straps 186, 188 may be sewn, for example.

Figure 5:
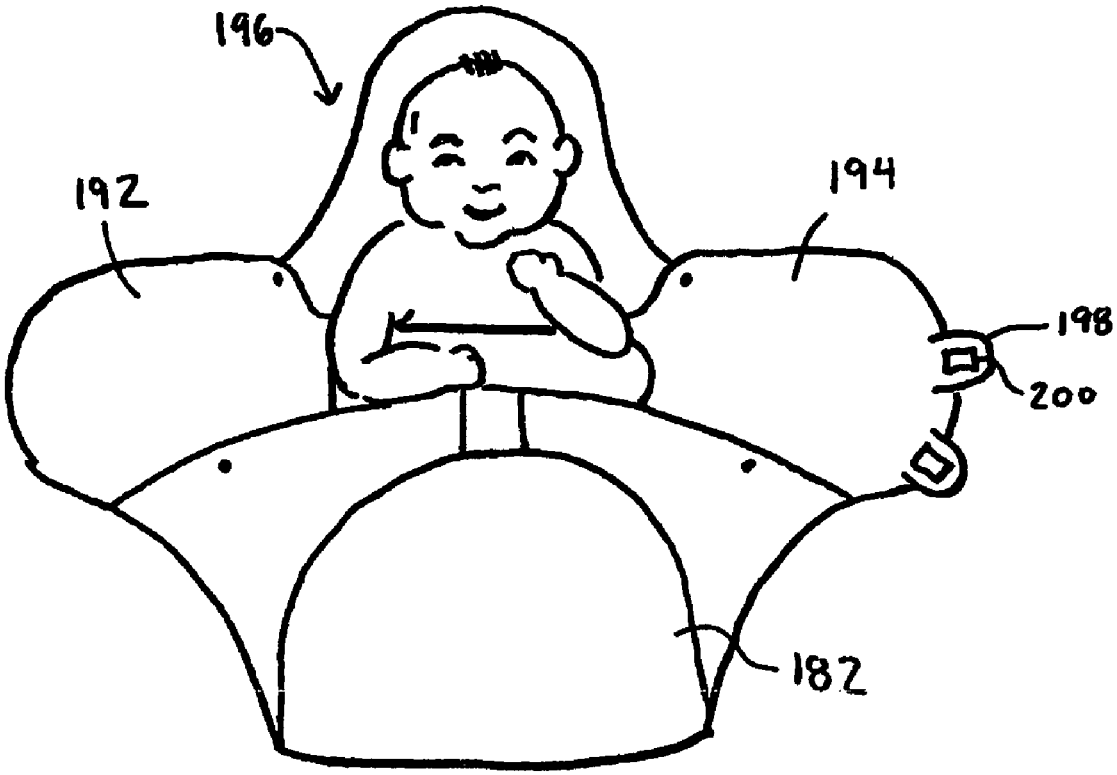
FIG. 5 is a top view of a swaddle blanket in use in yet another position.

Another fastener 204 may be included at a bottom tip 206 of the pocket 182, as shown in FIG. 3. Fastener 204 can be used to fold up the bottom end 178 of the swaddle blanket. Accordingly, the bottom end 178 can be adjusted to fit the length of the infant. In one embodiment, fastener 204 may be a piece of hook and loop material. The top of pocket 182 may include a corresponding patch 208 of hook and loop material. Thus, the bottom end 178 of the blanket can be folded upward and the fastener 204 can be attached to the patch 208 as shown in FIG. 5. Fastener 204 is not limited to hook and loop material and may take on other forms. For example, the fastener 204 could include a button hole, with the top of pocket 182 including a line of buttons. Accordingly, the pocket 182 could be folded up to a variety of different heights and attached to any of one of the buttons using the button hole 204.

Figure 6:
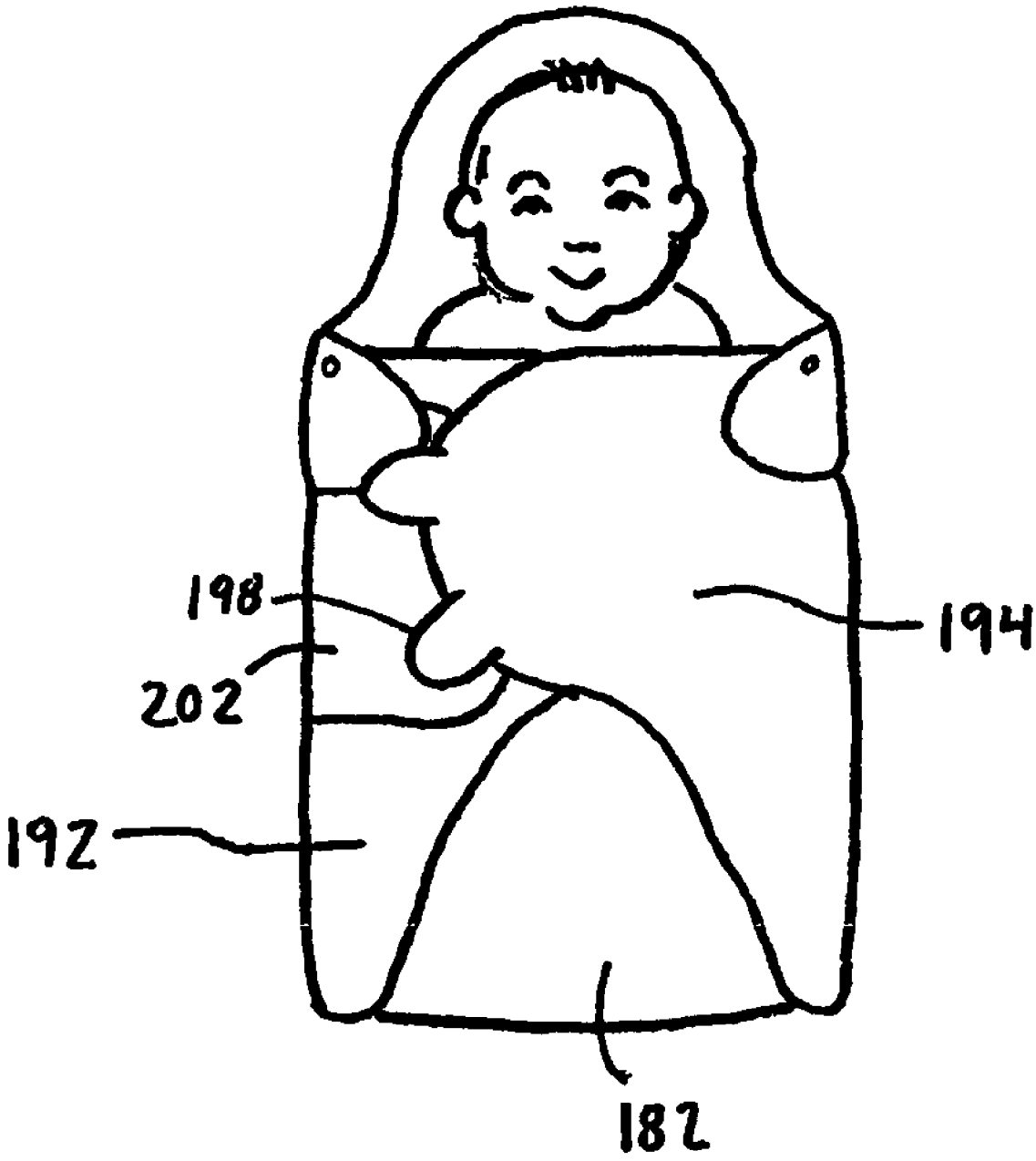
FIG. 6 is a top view of a swaddle blanket in use in another position.

FIGS. 4 and 5 illustrates that the sides of the swaddle blanket 170 are formed in the shape of wings 192 and 194 which extend from a central portion 196 of the blanket. The sides 192 and 194 are configured to wrap around the infant with the inner strap or inner straps 186, 188 held underneath the sides, as shown in FIG. 6. A first side wraps around the infant in one direction and the other side wraps around both the infant and the other side in a second direction. As a result, the infant may be tightly swaddled within the swaddle blanket 170, such that all of his limbs are enclosed inside the blanket. The two sides 192, 194 may be held in place around the infant with a fasteners 198. In the shown embodiment, the fastener 198 may be in the form of a tab extending from an edge of the right side 194 of the swaddle blanket 170. The fastener 198 may include one portion of a fastener pair 200, for example hook and loop material, as shown in FIG. 4. A back side of the swaddle blanket 174 may include a corresponding portion of a fastener pair 202. The fastener pair portion 202 on the back side of the swaddle blanket may be substantially larger than the fastener pair portion 200 on the tab, thereby allowing for easy adjustment of the tightness of the swaddle blanket.

Figure 7:
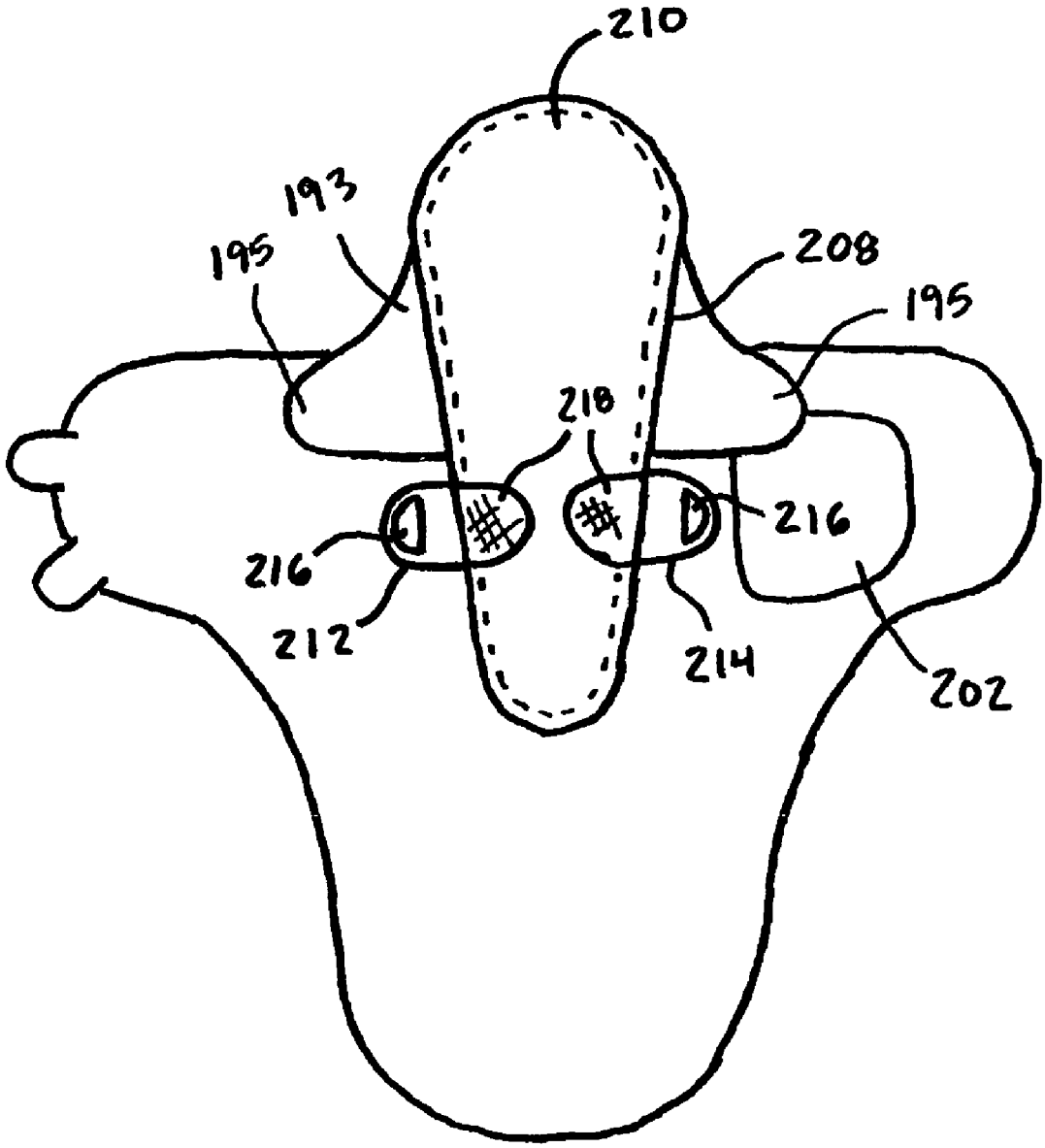
FIG. 7 is a bottom view of a swaddle blanket in one position.

The swaddle blanket 170 may also include a compartment 208 adjacent the back side 174 of the swaddle blanket and adapted to hold a pad 210, as shown in FIG. 7. The pad 210 provides a cushion for the infant that may add additional comfort when the swaddle blanket 170 is used on a sleeping surface, or it may serve to act as a sleeping surface on its own. The pad 210 may include a soft stuffing held inside a casing, or it can be formed of a foam material. The compartment 208 can be open on one end, so that the pad 210 can be inserted and removed from the swaddle blanket 170. In one embodiment, the pad 210 may be rigid on one side so that it can support an infant without the need of a support structure. Advantageously, the pad can have a tear drop shape. The tear drop shape allows the pad 210 and swaddle blanket 170 to be conveniently supported between a caretakers arm and hip. In another embodiment, the pad may include a temperature control device. For example, the pad may be a heating or cooling pad. If the pad is a heating pad, it may include an electrical heating device therein. The pad may also be filled with a fluid, such as a gel, that has a high heat capacity such that it maintains a desired temperature over a long period of time. Similarly, the pad could include substances that heat or cool as a result of a chemical reaction upon mixing or being exposed to air. The pad 204 may also be waterproof, or it may be wicking.

Figure 8:
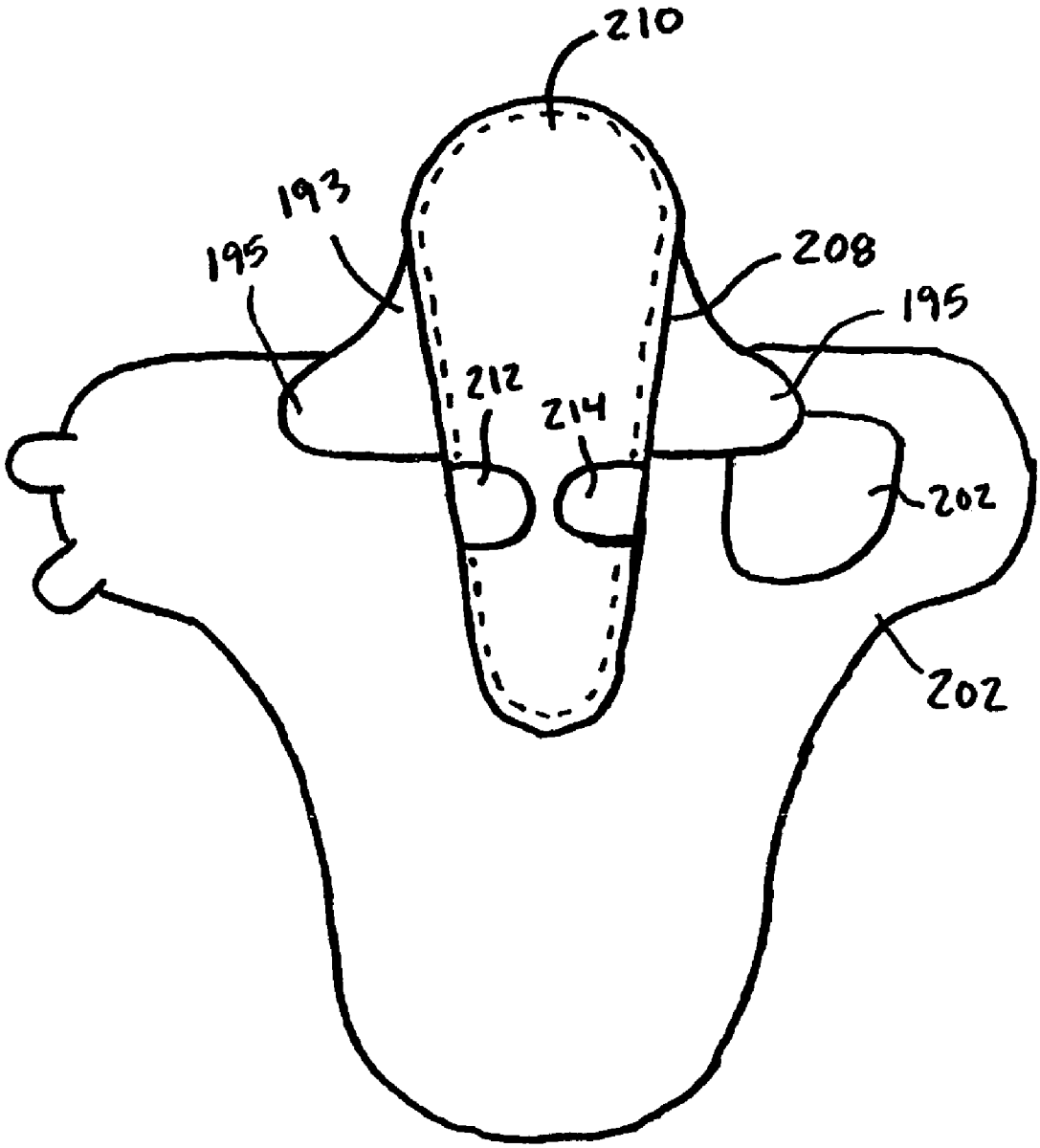
FIG. 8 is a bottom view of a swaddle blanket in another position.

The swaddle blanket 170 may include one or more attachment straps 212, 214 adjacent its back side 174. The attachment straps 212, 214 are adapted for attaching the swaddle blanket 170 to a mattress attachment device, as discussed below. The illustrated embodiment of the attachment straps 212, 214 are shown as two separate pieces which are each fixed to a central portion of the swaddle blanket 170. Each of the attachment straps 212, 214 includes a first mating fastener 216. The first mating fasteners 216 are provided to secure the blanket 170 to corresponding second mating fasteners 224 on the mattress attachment device. Advantageously, the blanket may include attachment strap holders 218 made of a second mating material adjacent each of the attachment straps 212, 214. Accordingly, as shown in FIG. 8, the attachment straps 212, 214 may be held fixed to the blanket using the first mating fasteners 216 and corresponding second mating material of the strap holders 218. The mating fasteners may take the form of any of the mating fasteners discussed above. In an advantageous embodiment, the first and second mating fasteners are respective hook and loop material fasteners.

As stated above, the attachment straps 212, 214 of the swaddle blanket 170 are configured for attaching the swaddle blanket to a mattress attachment device 222. Accordingly, the mattress attachment device 222 includes at least one second mating fastener 224 adapted to receive and attach to the first mating fasteners 212, 214 of the swaddle blanket. It should be noted that the mattress attachment device is not limited to use only with mattresses and may be configured for and used in conjunction with any sleeping surface, such as a bassinet or crib mattress.

Figure 9:
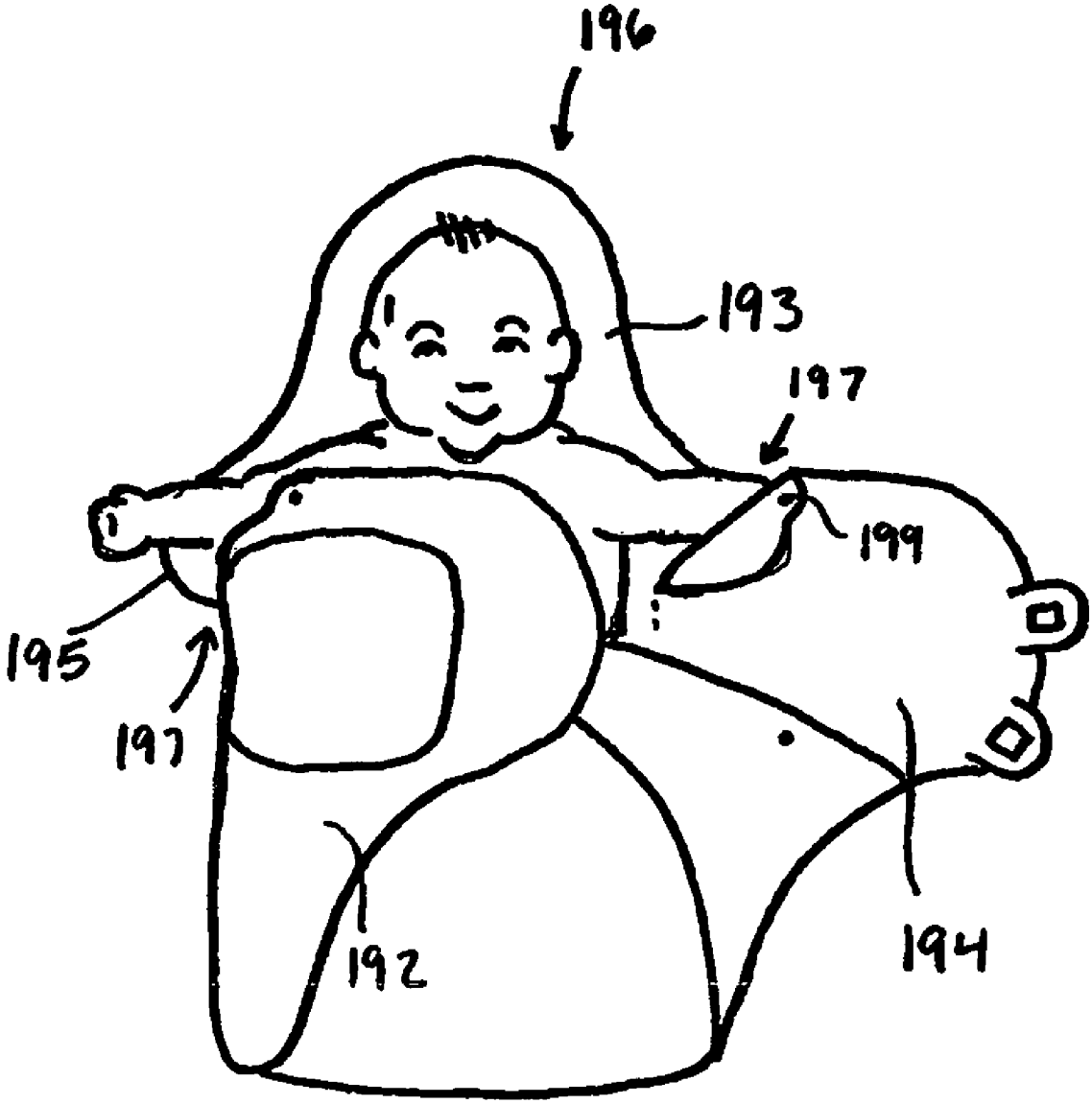
FIG. 9 is a top view of a swaddle blanket in use in another position.

FIG. 9 shows a configuration of the swaddle blanket 170 that allows the infants to be positioned freely outside the wrapped sides 192, 194. As illustrated in FIG. 4, the wing-shaped sides 192 and 194 may be formed of a separate piece of material from a head section 193 of the central portion 196. Accordingly, the head section 193 may have two tab sections 195 which are shown most clearly from the back in FIG. 7. A portion each wing-shaped side 192, 194 overlaps the corresponding tab 195 forming a slot 197 therebetween, shown in FIG. 4. In order to keep the slot closed, a fastener 199 is included on the tab 195 and on the side 192 or 194 near the slot. Thus, when the infant's arms are to be held within the swaddle blanket, the fasteners are held closed and both the wing-shaped sides 192, 194 and the tabs 195 are wrapped around the infant, as shown in FIG. 6. However, if it is preferred to have the infant's arms positioned outside the swaddle blanket, the fasteners 199 can be opened and the infant's arms placed through the slots 197, as shown in FIG. 9. This allows older infants to remain comfortable in the swaddle blanket with free motion of their arms. As an example, the fasteners 197 may be formed as snaps.

In addition to the swaddle blanket 170, the present invention also provides a system for securing an infant to a sleeping surface using a mattress attachment device 222. The mattress attachment device 222 may be used with any of a plurality of different sleeping units configured to wrap around an infant. For example, the mattress attachment device 222 can be used with the swaddle blanket 170 as shown in FIGS. 10-14, or the other blankets and sleep sacks described in the following. In a particular embodiment of this system, the mattress attachment device 222 is used with any of a plurality of sleeping units that include inner straps 186 and 188. This allows the infant to be secured to the mattress with the mattress attachment device 222 and also helps retain the infant within the sleeping unit using the inner straps 186 and 188.

Figure 10:
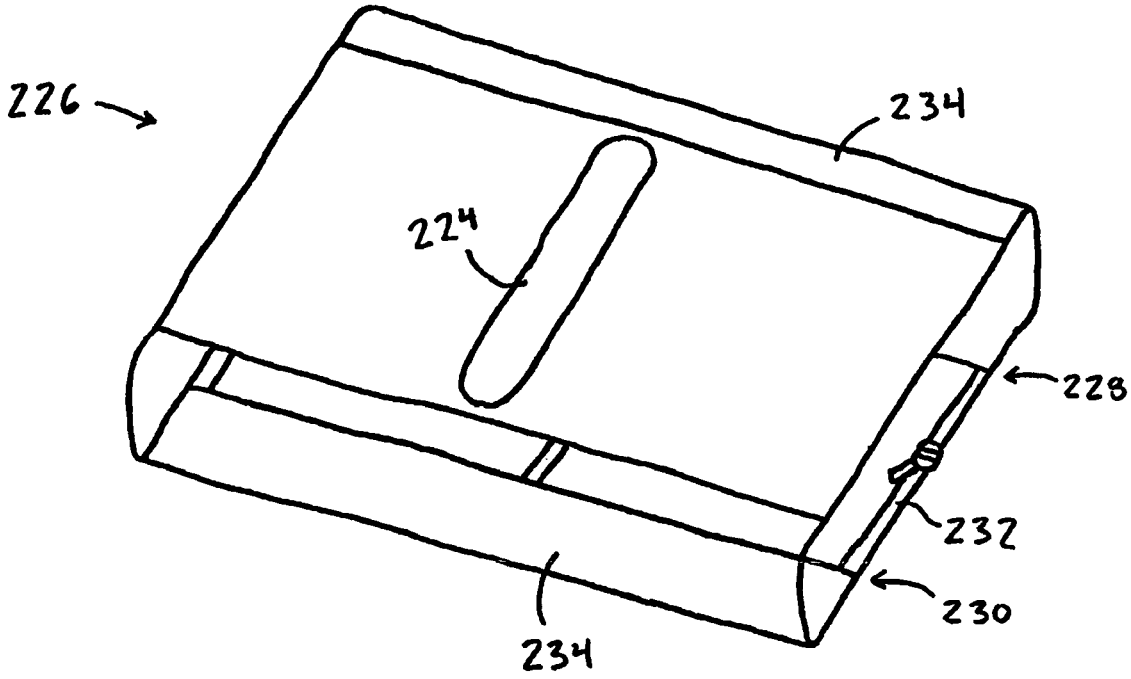
FIG. 10 is a perspective view of a mattress attachment device.
Figure 11:
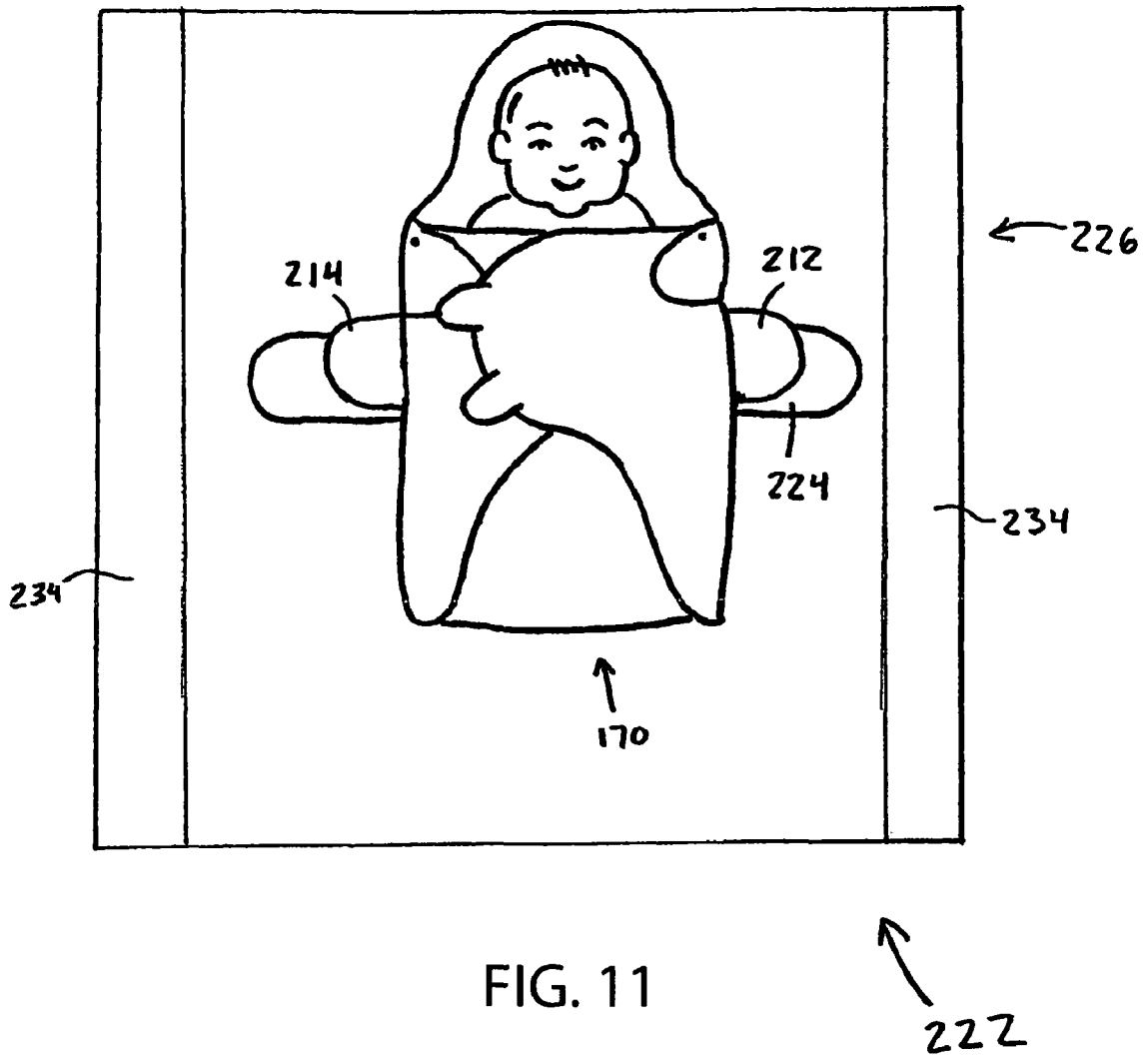
FIG. 11 is a top view of a swaddle blanket and mattress attachment device in use.

One embodiment of a mattress attachment device 222 in accordance with the present invention is shown in FIGS. 10 and 11. In this embodiment, the mattress attachment device 222 comprises a rectangular mattress attachment sheet 226 with a second mating fastener 224 disposed directly thereon. The rectangular mattress attachment sheet 226 is shown in FIG. 10 in perspective as though wrapped around a mattress or bassinet. The rectangular sheet 226 has a first end 228 and a second end 230 that each have sheet straps 232 extending therefrom. The sheet straps 232 are configured to be secured together around a sleeping surface. In the illustrated embodiment, the sheet straps 232 are attached using a buckle. Other methods may also be used to secure the sheet straps 232 together. Although the mattress attachment sheet 226 is shown as a rectangular sheet, other sheet configurations are also possible, such as the cover 52, rectangular sheet configurations 62 and 82, as well as fitted sheet 14, described below.

The mattress attachment sheet 226 can include substantially transparent sections 234 in the vicinity of both of its ends 228 and 230. The substantially transparent sections 234 may be made of a transparent plastic or a net or mesh material. The substantially transparent sections 234 allow the sides of the mattress or bassinet to be seen through the mattress attachment sheet 226.

The mattress attachment device 222 is shown in use in FIG. 11. As shown, the swaddle blanket is placed on the mattress attachment sheet 226 with its left and right attachment straps 212, 214 attached to the second mating fasteners 224. The attachment straps 212 and 214 extend outward and away from the infant so that they do not discomfort the infant. Preventing the infant from lying directly on top of the attachment straps provides additional comfort to the infant.

Figure 12:
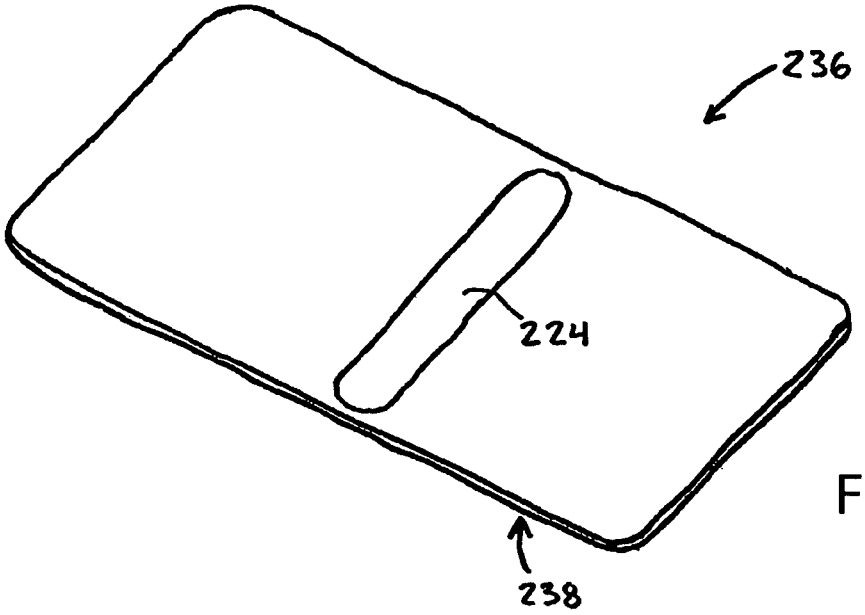
FIG. 12 is a perspective view of an intermediate sheet.
Figure 13:
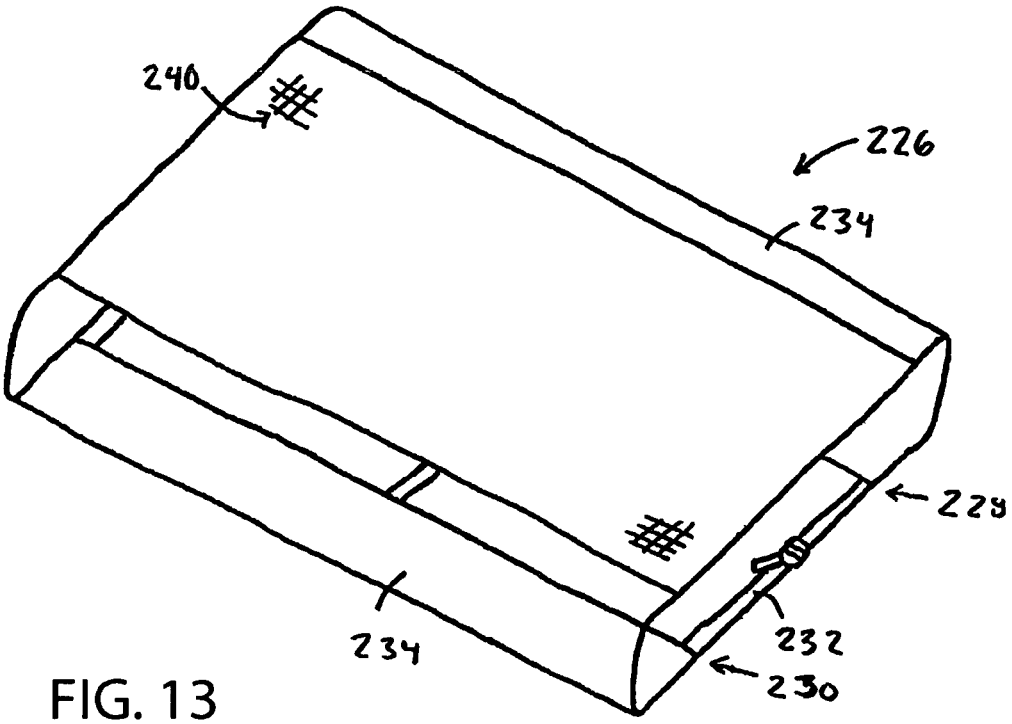
FIG. 13 is a perspective view of another embodiment of a mattress attachment device.
Figure 14:
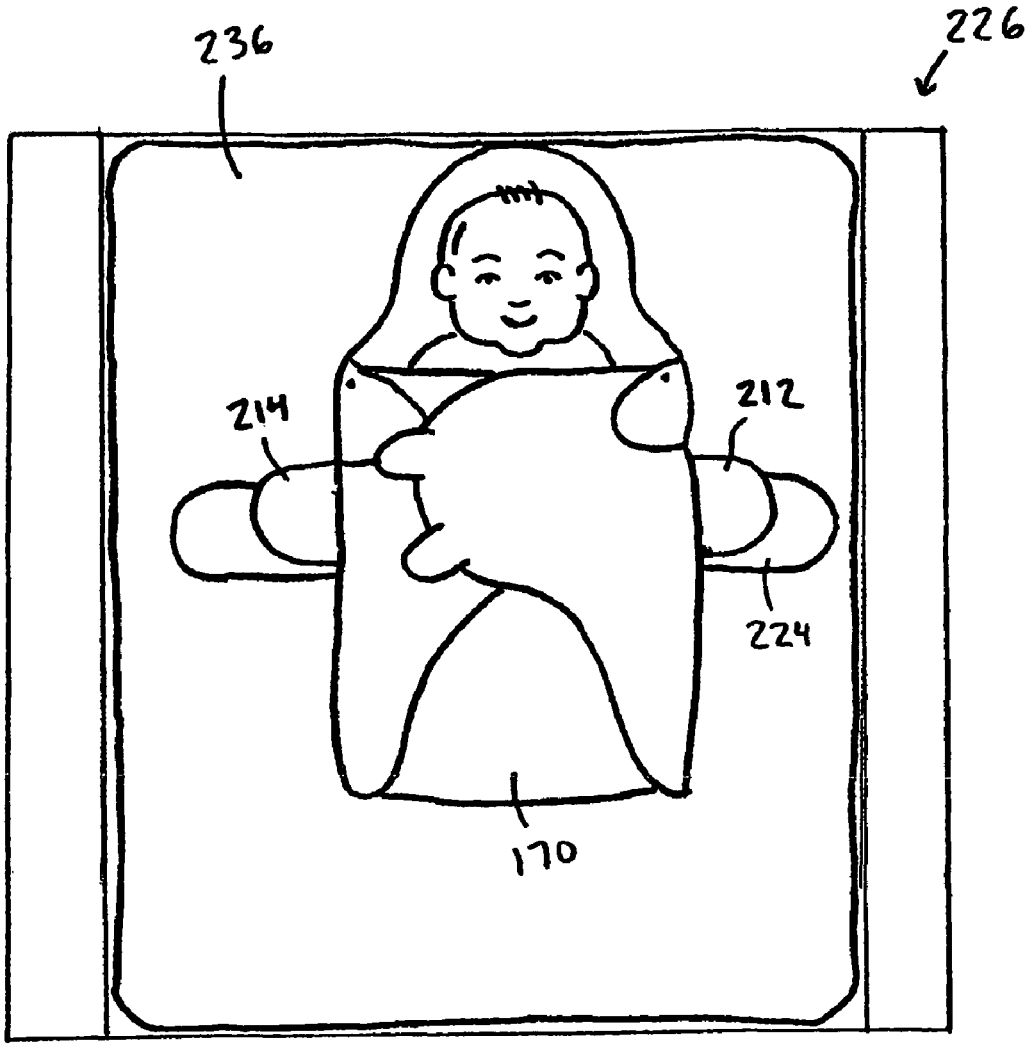
FIG. 14 is a top view of the mattress attachment device of FIG. 13 with a swaddle blanket in use.

Another embodiment of the mattress attachment device 222 is illustrated in FIGS. 12-14. In this embodiment, the mattress attachment device includes both a mattress attachment sheet 226 as well as an intermediate sheet 236. The intermediate sheet 236 is shown in FIG. 12. The intermediate sheet 236 includes a second mating fastener 224 to act cooperatively with the first mating fasteners 214 of attachment straps 212, 214. Additionally, the intermediate sheet 226 also includes a fourth mating fastener 238 on its bottom that is used to connect the intermediate sheet 236 to a respective third mating fastener 240 on the surface of the mattress attachment sheet 226, as shown in FIGS. 13 and 14. The third and fourth mating fasteners are illustrated as a hook and loop fastening materials. However, the third and fourth mating fasteners may also include plugs and sockets, buttons and button holes, or any other mating fastener pairs described above. In another embodiment, the fourth mating fasteners may be included on a top surface of the intermediate sheet 236 and the mattress attachment sheet 226 can include attachment flaps that fold over a portion of the intermediate sheet 236. In such an embodiment, the third mating fastener is included on the flaps so that the folded over flaps are attached to the intermediate sheet. In another embodiment, the intermediate sheet may include a temperature control device, such as that described above with respect to pad 204. For example, the intermediate sheet may be heating or cooling by including a material with a high heat capacity or a material that changes temperature as a result of a chemical reaction. Further, the intermediate sheet may include an electrical heating device therein. The intermediate sheet may also be waterproof to prevent leaks from damaging the sleeping surface. The intermediate sheet can alternatively be wicking, in order to provide additional comfort to the infant.

Figure 15:
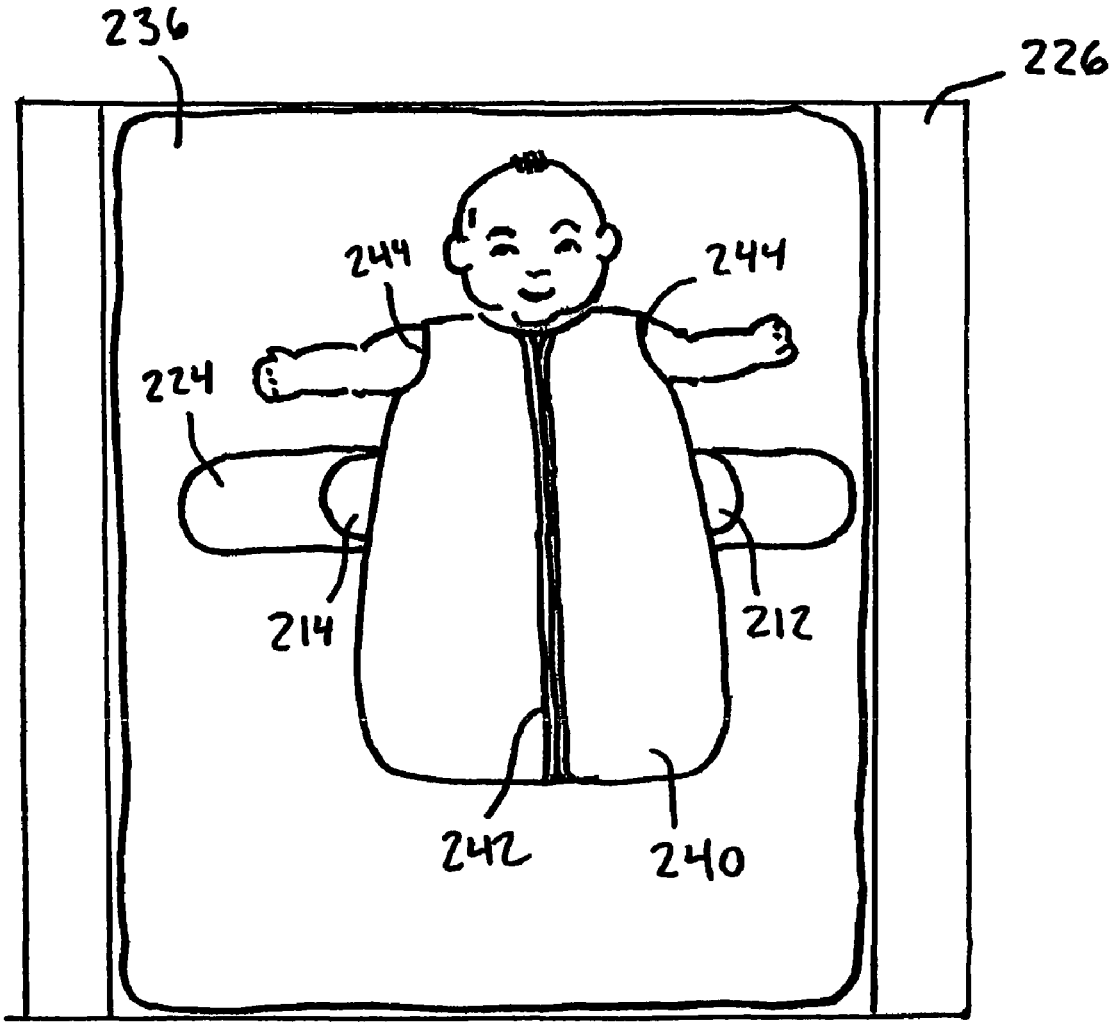
FIG. 15 is a top view of the mattress attachment device of FIG. 13 with a sleep sack in use.
Figure 16:
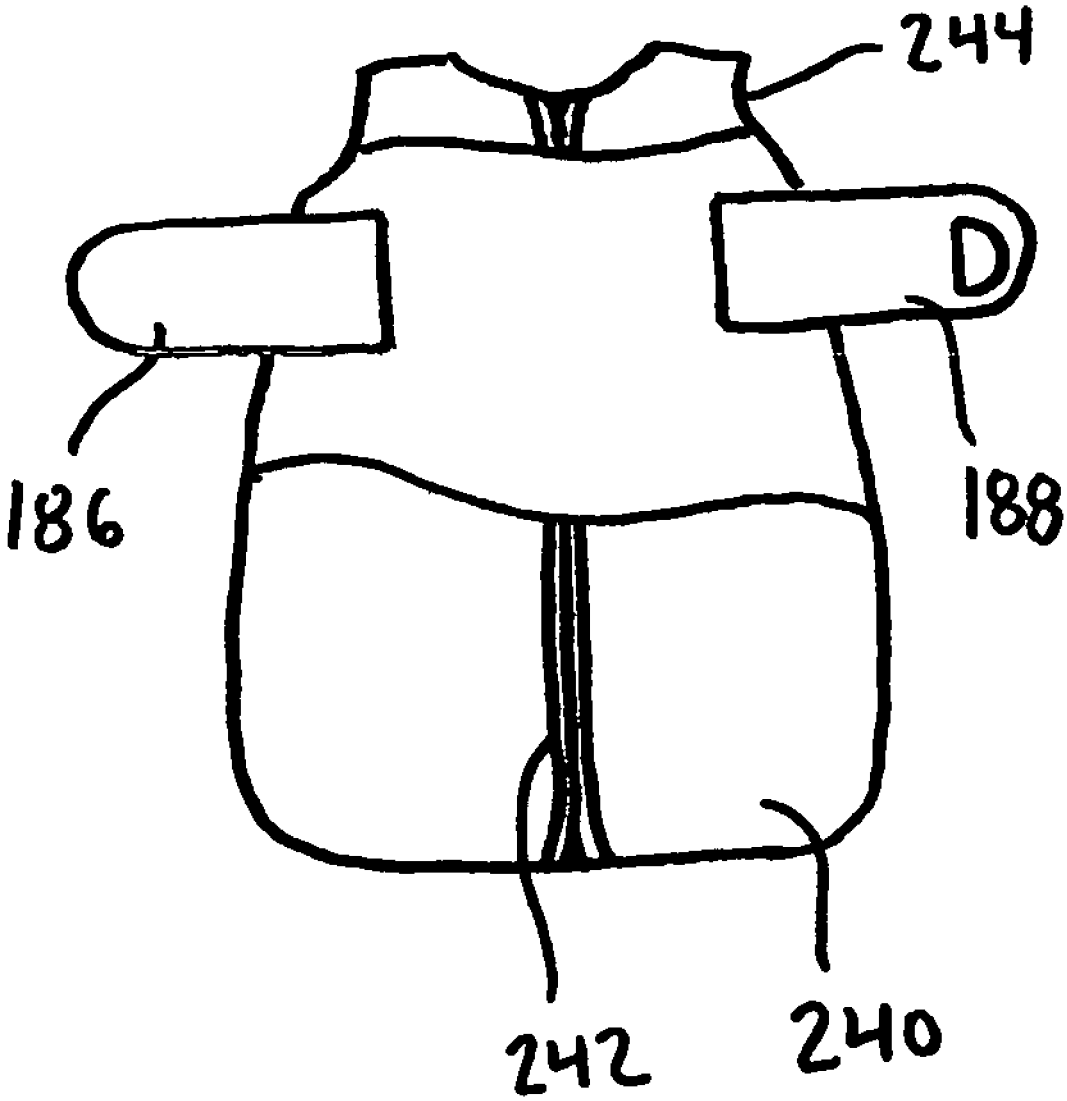
FIG. 16 is a cut-away view of the sleep sack shown in FIG. 15.

FIG. 15 shows a different sleeping unit, namely a sleep sack 240, in use with the mattress attachment device 222 shown in FIG. 14. The sleep sack 240 is similar to the swaddle blanket 170, in that it includes a body that is formed of a textile material. However, the sleep sack 240 provides more freedom of movement than the swaddle blanket 170 as described below. Sleep sack 240 may include a zipper 242 on its front to allow easy access to the sleep sack. In one embodiment, the zipper may be made of nylon. The sleep sack 240 also includes arm holes 244. Not only are the infant's arms free positioned freely through the arm holes 244, but the sleep sack 240 itself is not as confining as the swaddle blanket 170. However the sleep sack 240 can include inner straps 186 and 188 so that the infant is securely held therein. The inner straps 186 and 188 are disposed within the sleep sack 240 as shown in FIG. 16, which has a front portion of the sleep sack 240 cut away so that the inner straps 186 and 188 are viewable. The combination of the mattress attachment device 222 used in connection with various sleeping units that include the inner straps 186 and 188, provides a system that allows for progressive freedom of movement for the infant as it grows. The swaddle blanket 170 may be used while the infant is still young, first in the configuration with the arms held inside, and later in the configuration with the arms free. As the infant grows, the sleep sack 240 may replace the swaddle blanket while still using the mattress attachment device 222. Thus, the variety of sleeping units 170 and 240 provide a adaptable system that can change to accommodate the needs of the infant.

Figure 17:
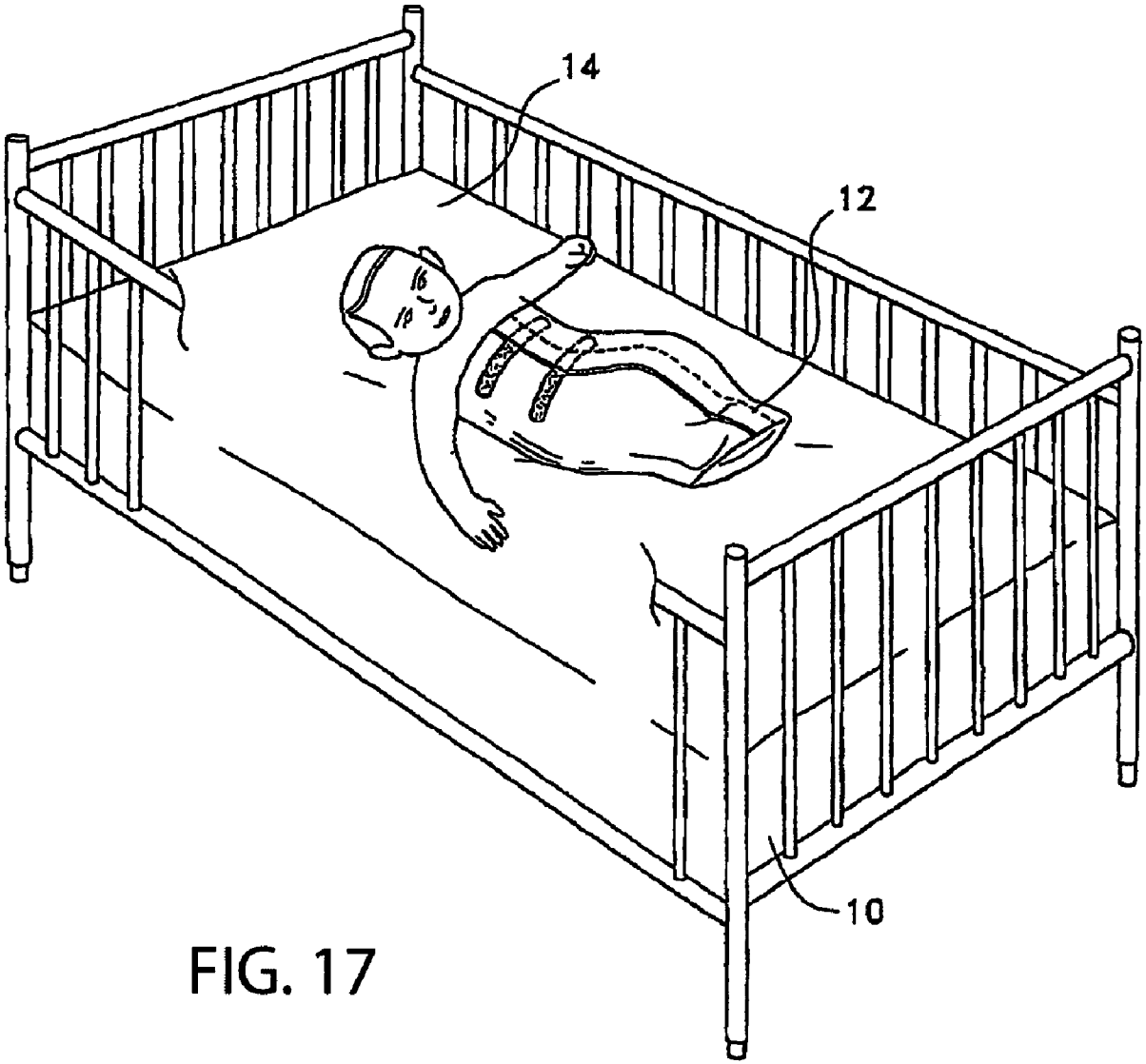
FIG. 17 is a perspective view of a crib safety sheet and blanket according to an embodiment of the present invention with an infant secured in the blanket.

Another embodiment of the present invention is the combination of an infant crib safety sheet and blanket 10 as seen in FIG. 17. This embodiment is also installed on a mattress in a crib, bassinet, or the like. The combination has a blanket portion 12 (blanket) with a front surface and a back surface. The blanket is attached to a fitted sheet portion 14. The blanket 12 of the shown embodiment is sewn to the middle of the front surface of the fitted sheet 14 by stitching along the longitudinal midline of the blanket portion 12, defining two halves of the blanket which may be folded or wrapped about the infant. When in use, the blanket 12 is wrapped around an infant's torso and lower extremities (with one side overlapping the other side) so as to keep the infant warm and securely positioned in the center of the safety sheet and blanket 10 on its back or side. The blanket 12 is held in position around the infant with four mating strips of hook and loop fastening material (discussed below).

When secured in the safety sheet and blanket of this embodiment, the infant retains full motion in its arms and head and some lateral motion but is unable to roll completely over or to extract itself from the blanket 12. Alternatively, the arms may also be secured in the blanket. By securing an infant in this manner there is a lower chance of sudden infant death syndrome, which is normally associated with infants sleeping in the prone position. The infant has no loose bedding materials upon which to suffocate, and the infant cannot kick free of its blanket and become cold during sleep.

Figure 18:
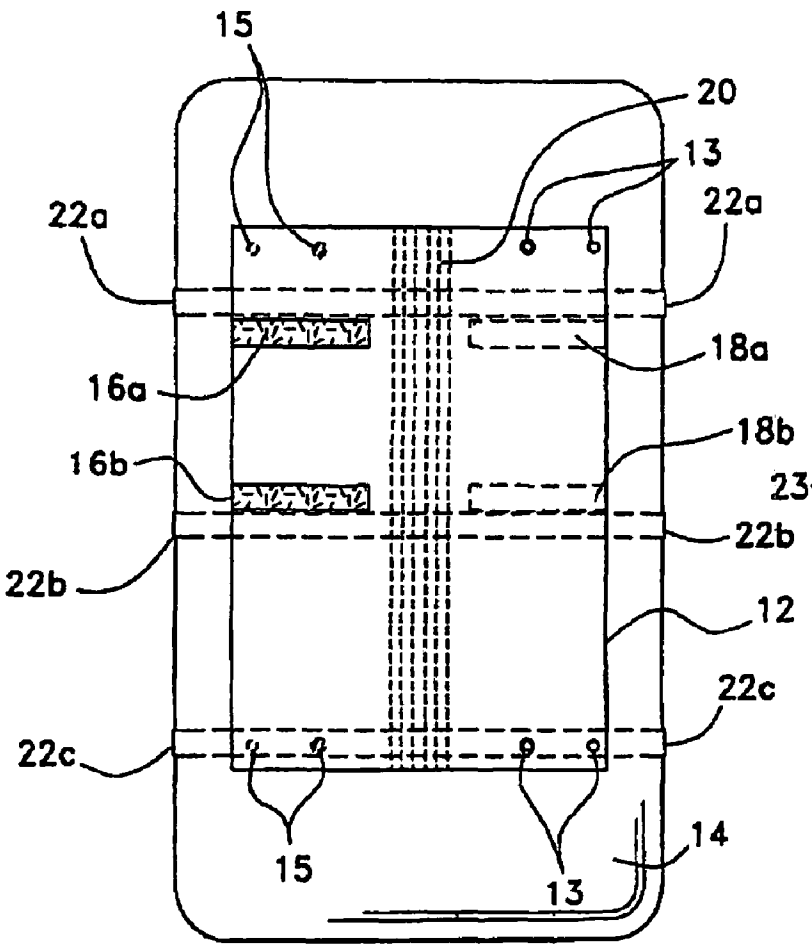
FIG. 18 is a top view of a crib safety sheet and blanket positioned around a mattress.

FIG. 18 is a top view of the safety sheet and blanket wrapped around a mattress with the blanket 12 laid flat against the sheet 14 and the back surface of the blanket 12 coming into contact with the front surface of the sheet 14. The stitching 20, which secures the blanket 12 to the sheet 14, can be seen in this view. The hook and loop fastening material 16*a*, 16*b* sewn to the front surface of the blanket 12 removably attaches to corresponding hook and loop fastening material 18*a*, 18*b* sewn to the back surface of the blanket 12. FIG. 18 shows two sets of mating hook and loop fasteners (16*a* with 18*a*, and 16*b* with 18*b*) but additional fastener strips maybe attached and used if a more secure hold is required. FIG. 18 also shows the three elastic straps 22*a*-22*c* that wrap under the mattress (discussed below) to secure the flat edges of fitted sheet 14 to the mattress 24.

The blanket as seen in FIG. 18 may be adapted for smaller infants by folding the sides of the blanket to reduce the blanket's overall width. Preferably, the right side of the blanket would be folded toward the front surface of the blanket and fastened with snap fasteners 13 present thereon. The left side of the blanket would preferably be folded toward the back surface of the blanket and secured with snap fasteners 15 present thereon.

Figure 19:
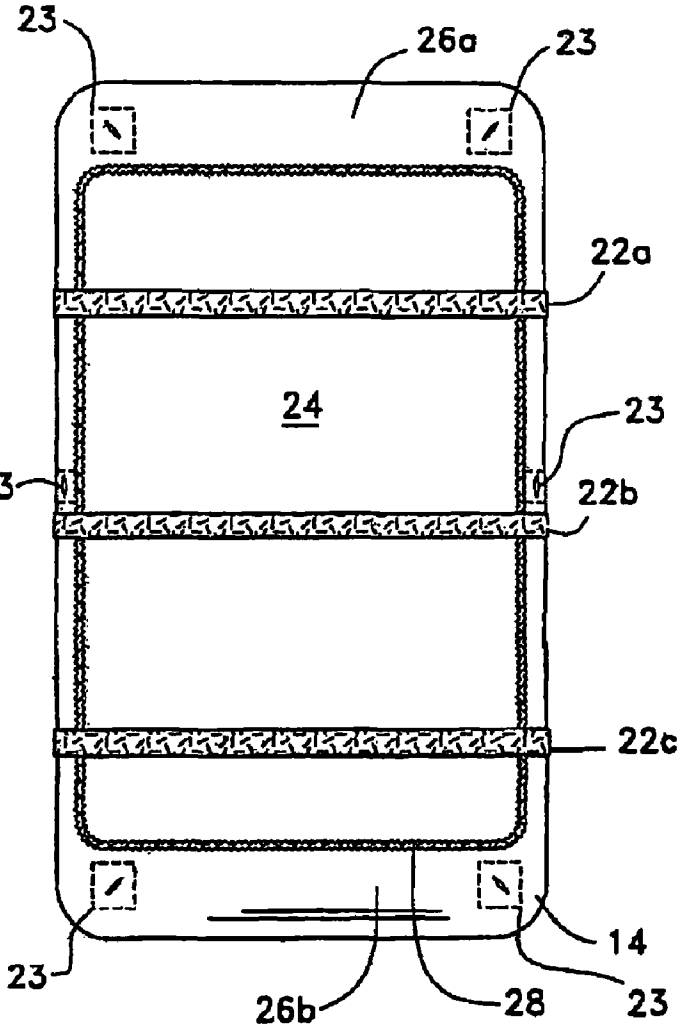
FIG. 19 is a bottom view of a crib safety sheet and blanket positioned around a mattress.

FIG. 19 is a bottom view of a safety sheet and blanket 10 wrapped around a mattress 24. This view shows the two pockets 26*a*, 26*b* defined in the fitted sheet 14 which secure the fitted sheet to the foot and head portions of a mattress 24. An elastic band 28 functions to keep the two pockets 26*a*, 26*b* securely wrapped around a mattress. Three elastic straps 22*a*, 22*b*, and 22*c* keep side edges of the fitted sheet 14 secured to the mattress. The sheet 14 may have several cloth reinforced grommets 23 dispersed along the sides the sheet. These grommets 23 may serve as anchor points for bungee cords or other suitable holding devices when securing the crib sheet and blanket combination to the bed frame of a large bed so that the crib safety sheet and blanket 10 may be used when a crib is not available, e.g., when traveling.

Figure 20:
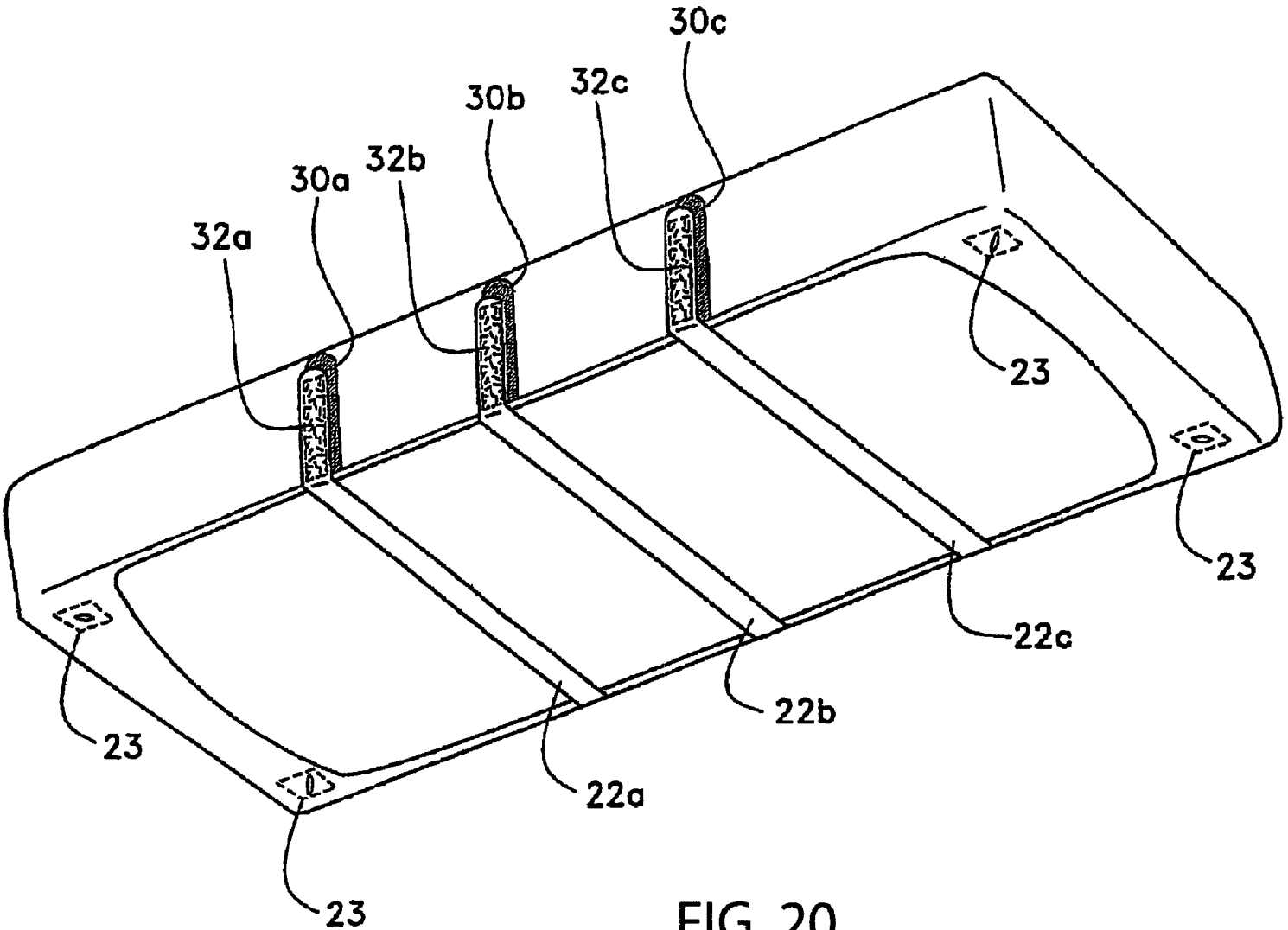
FIG. 20 is a perspective view of the bottom of a mattress equipped with an infant safety sheet and blanket.

FIG. 20 shows a perspective view of the bottom of safety sheet and blanket 10 of FIG. 17. The elastic straps 22*a*-22*c* are removably attached to one side of the fitted sheet 14, one strip of hook and loop fastening material 30*a*-30*c* for each strap 22*a*-22*c* being sewn to the fitted sheet 14 and a mating strip of hook and loop fastening material 32*a*-32*c* (seen in relief) being sewn to the elastic straps 22*a*-22*c*.

Figure 21:
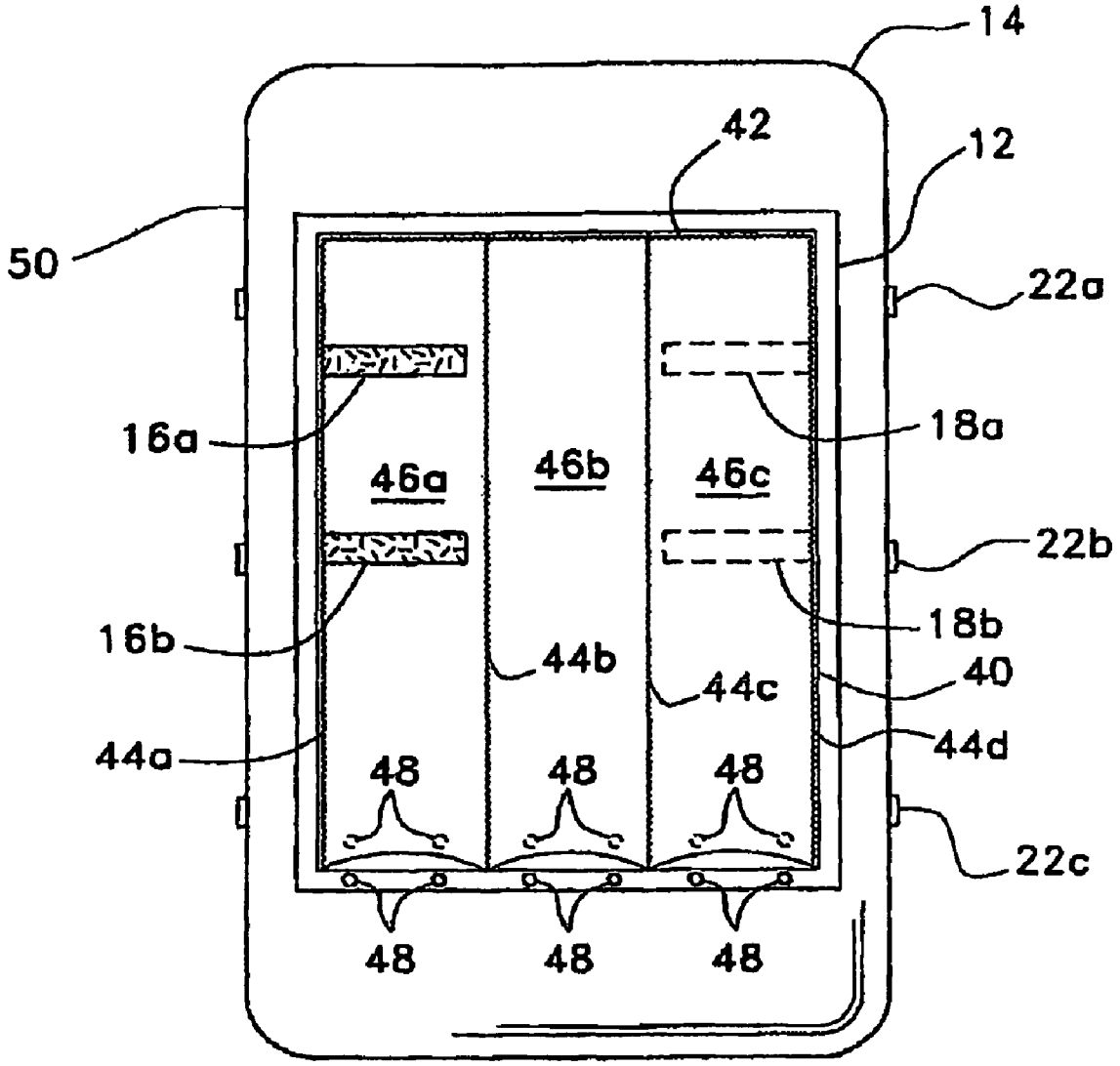
FIG. 21 is a top view of another safety sheet and blanket positioned around a mattress.

FIG. 21 shows a feature 50 of the safety sheet and blanket that is used for infants who need additional physical support while sleeping. This feature and all following features are similar to the first feature and the same reference numbers represent identical components. The second feature of the safety blanket/sheet combination has a second blanket 40 with a top and bottom surface that is attached to the first blanket 12. The first blanket 12 is shown larger in this figure for illustration purposes. One horizontal line of stitching 42 holds together the tops of both blankets and four vertical lines of stitching 44*a*-44*d* hold together the edges and the centers of the blankets. The four vertical lines of stitching 44*a*-44*d* also divide the blankets into three vertical sheaths 46*a*-46*c*. The bottoms of the sheaths 46*a*-46*c* maybe closed using the snap fasteners 48 located on the bottom surface of the second blanket 40 and the top surface of the first blanket 12. Hook and loop fastening material, zippers, and any other fastening devices known to one skilled in the art may be substituted for the snap fasteners. Some of the hook and loop fastening material 16*a*, 16*b* has been moved in this feature to the top surface of the second blanket 40 from their position in the first feature on the top surface of the first blanket 12.

Another feature of the crib safety sheet and blanket combination is used in the same manner as the first feature except that supportive material such as egg-crate cushioning material or air pad-type material may be inserted into the sheaths 46*a*, 46*b*, 46*c*. Temperature regulating material such as hot and cold packs may also be inserted into the sheaths 46*a*, 46*b*, 46*c*. The supportive material is secured inside the sheaths by using the snap fasteners 48 located at the bottom of the sheaths.

Additional features of the crib safety sheet and blanket will now be described. These features involve modifications to the fitted sheet. These features may employ either the blanket 12 described with respect to FIGS. 17-20 or the double blanket 12, 40 design described with respect to FIG. 21. The following description describes modifications to the sheet and their use with only the first blanket 12 for clarity.

Figure 22:
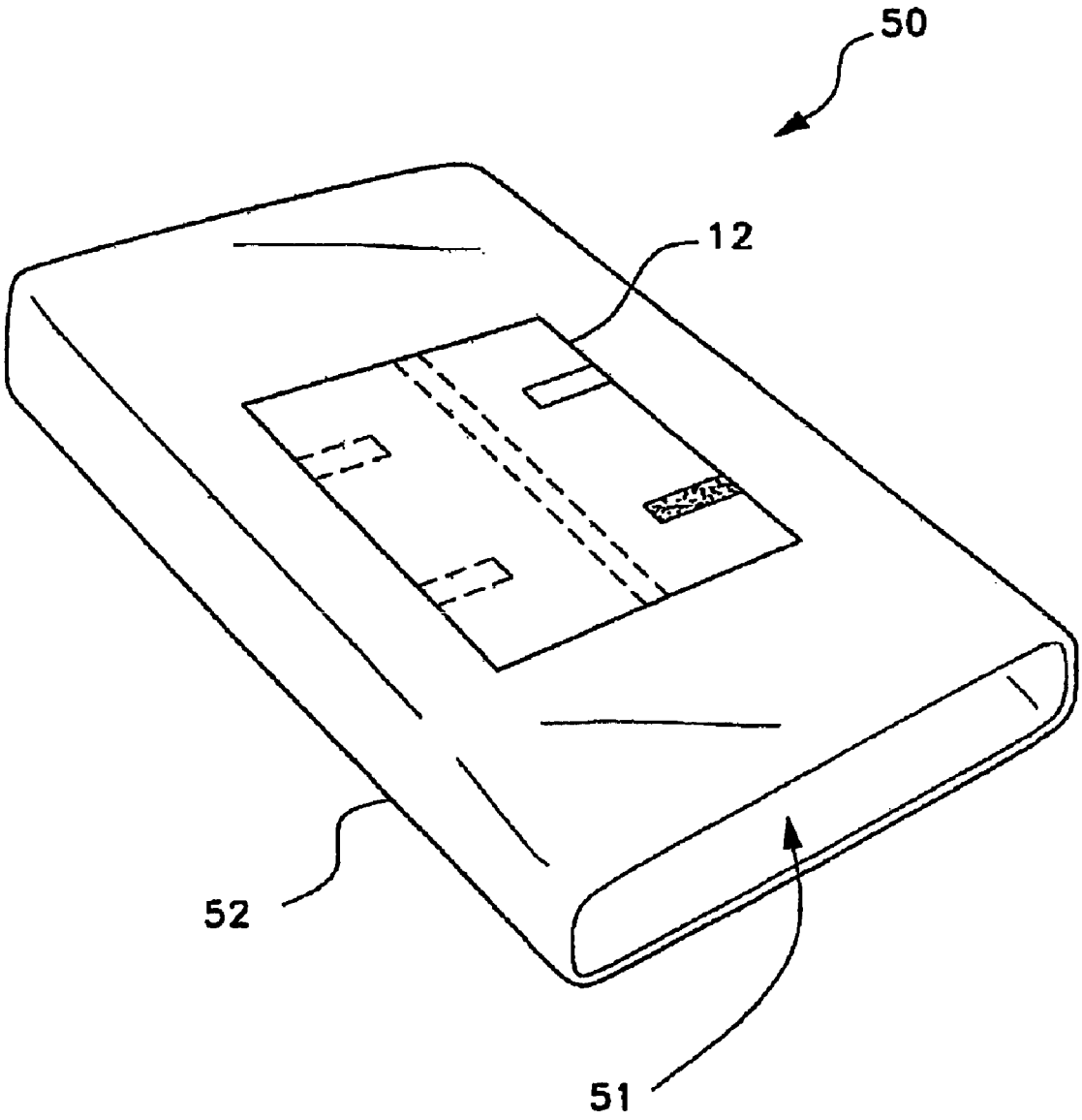
FIG. 22 is a top perspective view of another embodiment of the present invention.

Another feature 50 of the present invention, as shown in FIG. 22, replaces the fitted sheet of the first feature with a cloth sack 52 or case generally resembling an enlarged pillow case. The sack 52 has a top surface, bottom surface and at least one opening 51, the top surface being formed by a sheet as an integral part of the sack 52. Bedding material such as a basinet pad or a small mattress is ordinarily inserted into the sack 52 through the at least one opening 51. The blanket 12 is sewn to the top surface of the sack 52 in the same manner that the blanket 12 is attached to the fitted sheet 14. In all other respects the blanket 12 is identical to the first feature, and will not be described further. Although the sack 52 is shown having the opening 51 at one end thereof, it is well within the purview of this invention that the opening 51 extends either along the side, or across the bottom (e.g., a sham). In this feature, the majority of the bedding material is enveloped by the sack 52.

Figure 23:
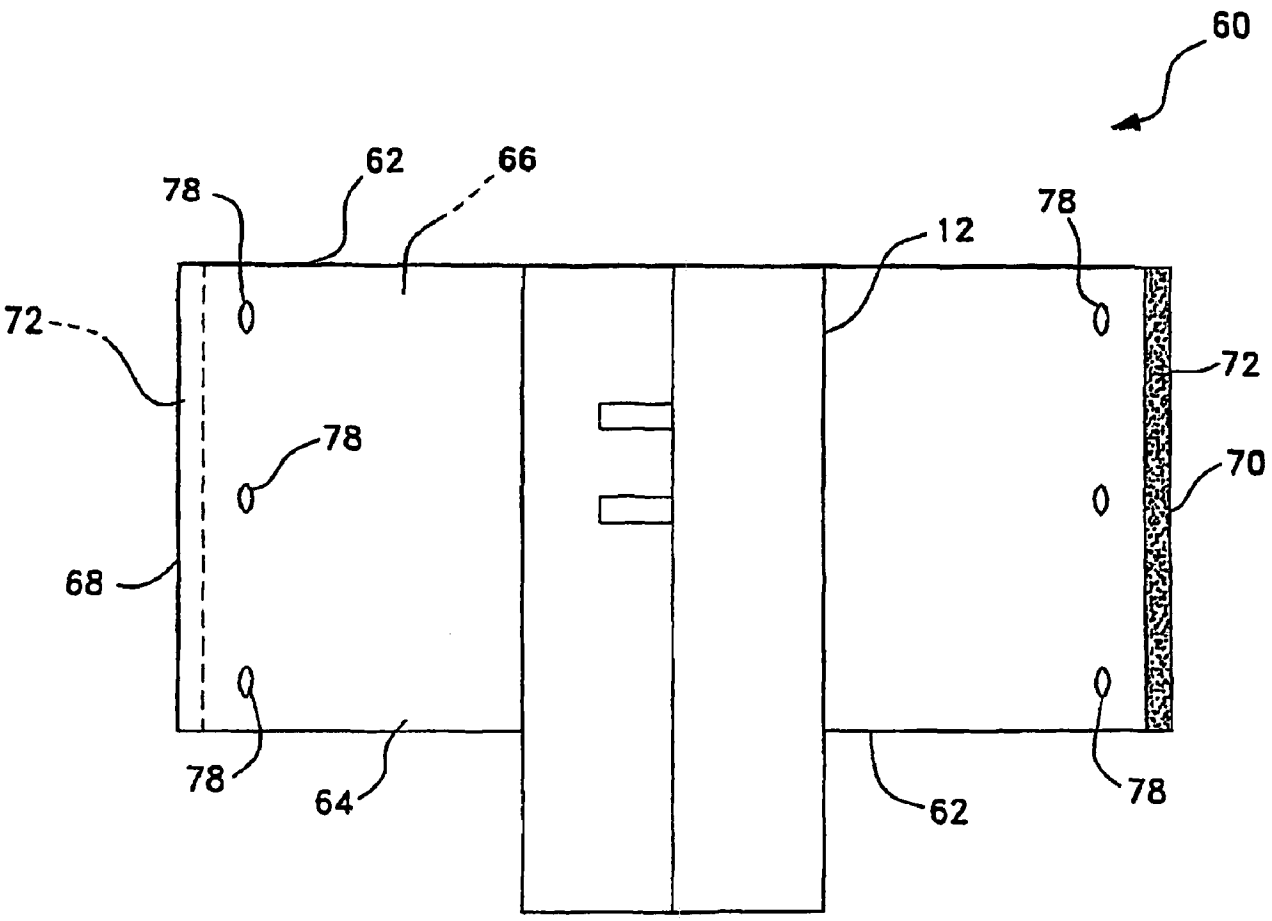
FIG. 23 is a top view of yet another embodiment of the present invention.

Another feature 60 of the present invention is illustrated in FIG. 23. This feature 60 substitutes a rectangular sheet 62 of material in place of the fitted sheet 14 of the first feature. The sheet 62 has a front surface 64, back surface 66, a top edge, a bottom edge, a left edge 68 and a right edge 70. A fastening device such as hook and loop material 72 is disposed upon both the right 70 and left 68 edges. Snap fasteners or any other suitable fastening devices may also be used in place of the hook and loop material. The sheet 62 further has plurality of apertures 78 defined between its front 64 and back 66 surfaces. The apertures 78 are preferably located close to, and parallel to, the right 70 and left 68 edges. However, placement of the apertures 78 near the edges 68 and 70 of the sheet is not a critical aspect of the invention, and the apertures 78 may be more centrally located as discussed below. As in the third feature, the blanket 12 is sewn to the front surface 64 in the same manner as the blanket 12 is attached to the fitted sheet 14, and is identical in all other respects to the blanket 12 of the first feature, and will not be described further.

Figure 24:
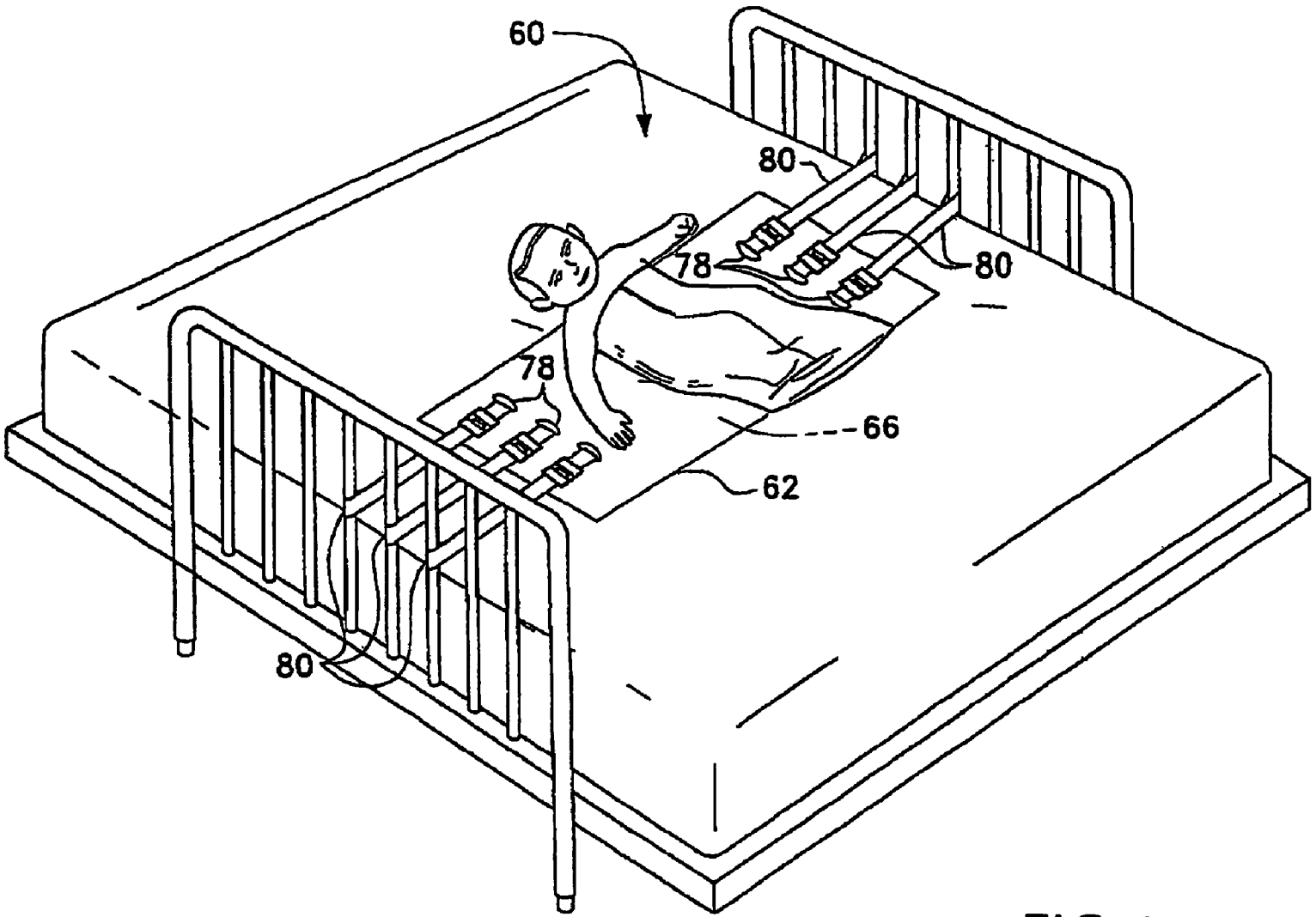
FIG. 24 is a perspective view of an embodiment of the present invention in use.

Feature 60 may be used as illustrated in FIG. 24 on a full size adult mattress. The sheet 62 is placed back surface 66 down on the top surface of a mattress. Adjustable straps 80 are looped through the apertures 78 and through posts on the bed frame or an accessory guard rail in order to secure the sheet 62 to the mattress. It is well within the ability of one skilled in the art to design a wide range of suitable apertures 78 ranging from cloth reinforced slits to metal or plastic reinforced rings. It must be noted, however, that any apertures containing hard or uncomfortable materials should be located more centrally on the sheet so as not to become uncomfortable to an infant when the invention is used on crib pads or bassinets as discussed below.

Figure 26:
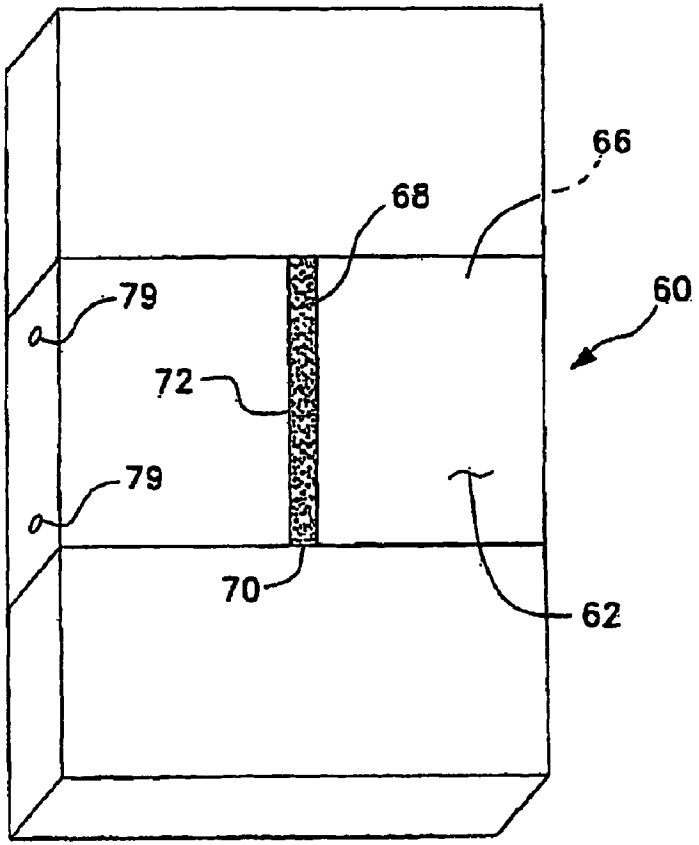
FIG. 26 is a bottom perspective view of the embodiment shown in FIG. 25.
Figure 25:
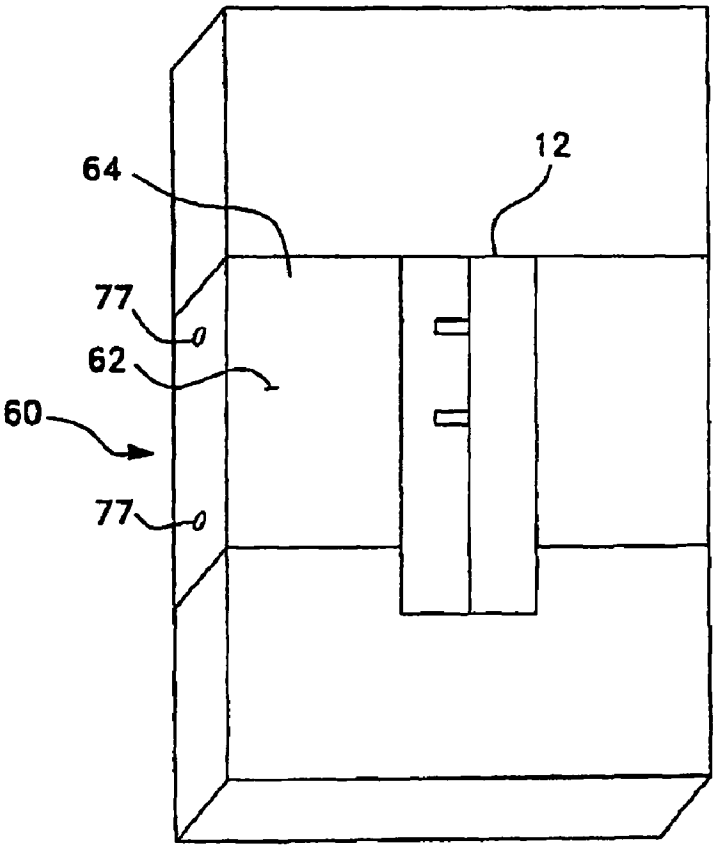
FIG. 25 is a top perspective of an embodiment of the present invention.

Feature 60 may also be used on smaller bedding materials, such as a crib mattress, as shown in FIGS. 25 and 26. For these smaller applications the sheet 62 is wrapped completely around the mattress approximately midway between the head and foot of the mattress, with the back surface 66 of the sheet 62 coming into contact with the mattress. The left 68 and right edges 70 of the sheet are secured to one another using the aforementioned hook and loop material 72.

Feature 60 may also be used on even smaller bedding material such as a bassinet pad. First, the left 68 and right 70 edges of the sheet are attached to one another as detailed above, but without the intervening mattress. The double thickness sheet 62 is then wrapped around a bassinet pad or the like. The sheet 62 is then secured in position by connecting fasteners 77 to fasteners 79.

Figure 27:
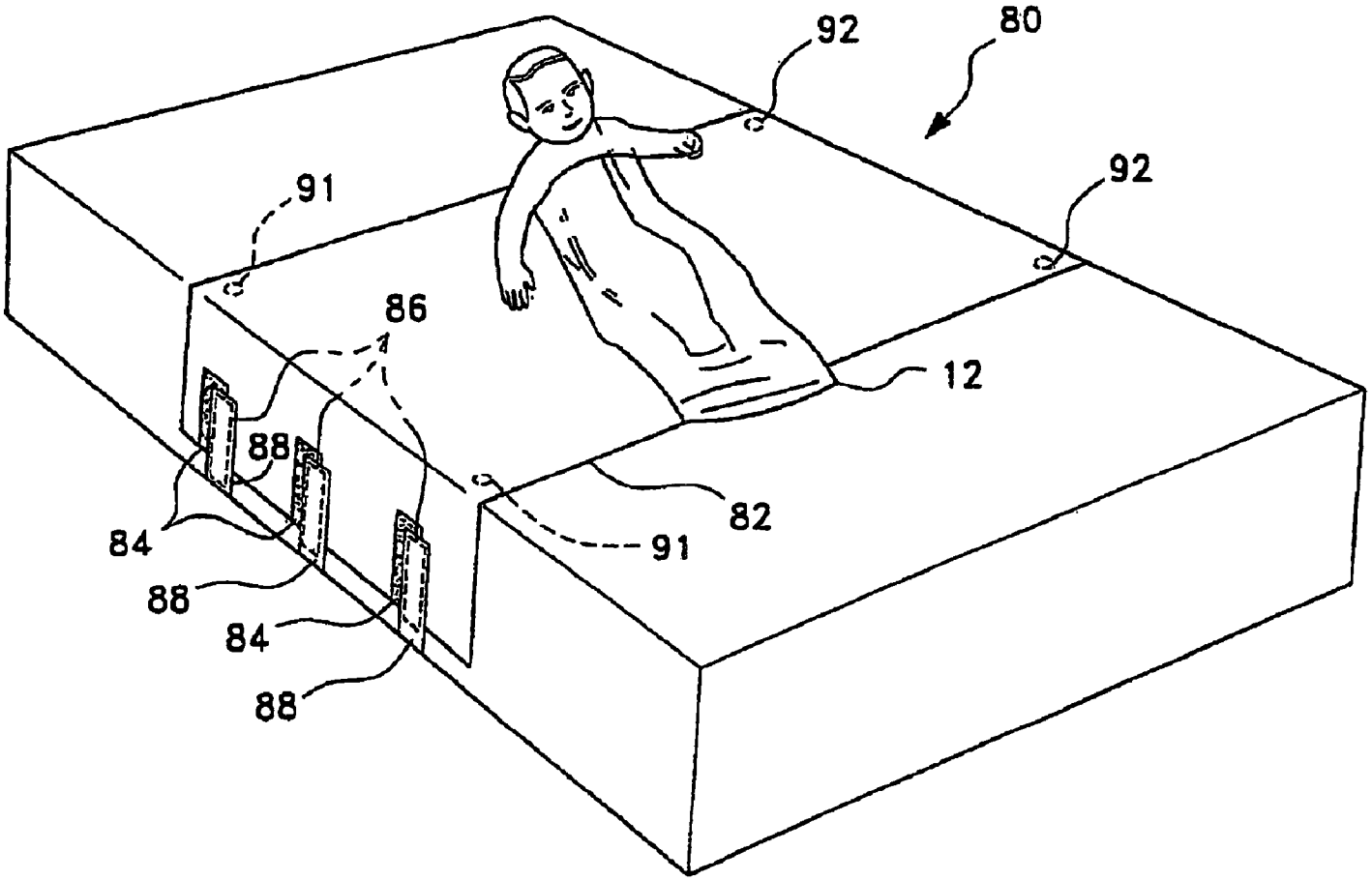
FIG. 27 is a top perspective view of an embodiment of the present invention in use.
Figure 28:
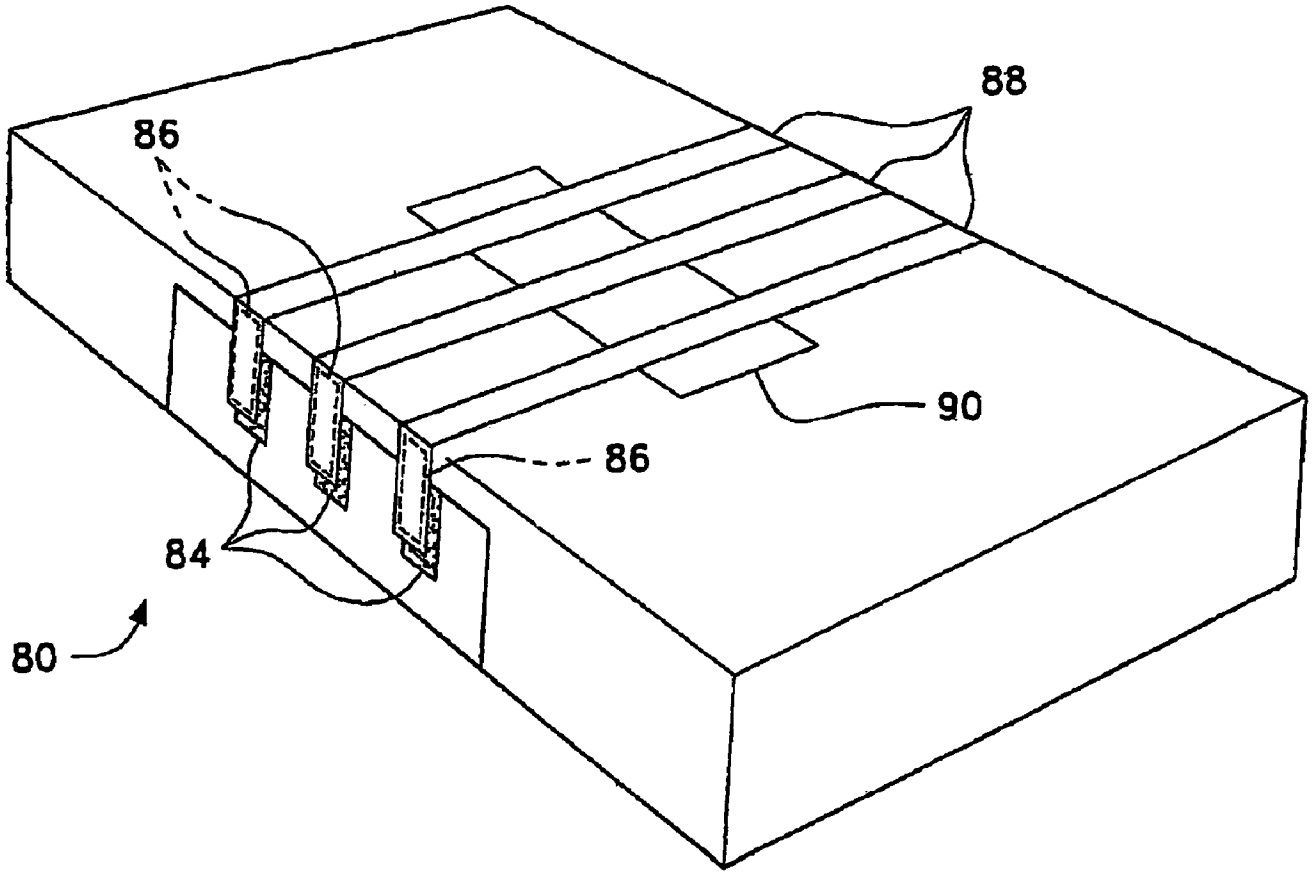
FIG. 28 is a bottom environmental perspective view an embodiment the present invention.

Feature 80 of the present invention, as illustrated in FIGS. 27 and 28, uses the blanket 12 of the first feature but substitutes a generally rectangular sheet 82 for the fitted sheet 14 of the aforementioned feature. The sheet 82 has a front surface, back surface, and two opposing ends. Disposed adjacent to each opposing edge are several sections of hook and loop material 84.

Several straps 88 have one end attached to the sheet 82 and are wrapped around beneath the mattress or crib frame, having a second end with corresponding sections of hook and loop material 86 which are releasably attachable to the aforementioned hook and loop material 84 on the sheet 82. Hook and loop material is the preferred method of strap attachment but any suitable method including but not limited to, buttons, snaps and buckles may also be used. The straps 88 themselves preferably have elastic properties, but any suitable strap may be used. Each of the straps 88 is attached to or threaded through a spacer 90. The spacer 90 is a flat, generally rectangular sheet which serves to hold the straps and keep the straps 88 properly positioned and oriented. In use, the spacer will be disposed beneath the mattress. The fifth feature 80 also has two sets of corresponding fasteners 91, 92. Fasteners 91 are designed to attach to opposing fasteners 92 and in so doing reduce the overall size of the sheet 82 and thereby prepare the apparatus for smaller size bedding materials.

Figure 35:
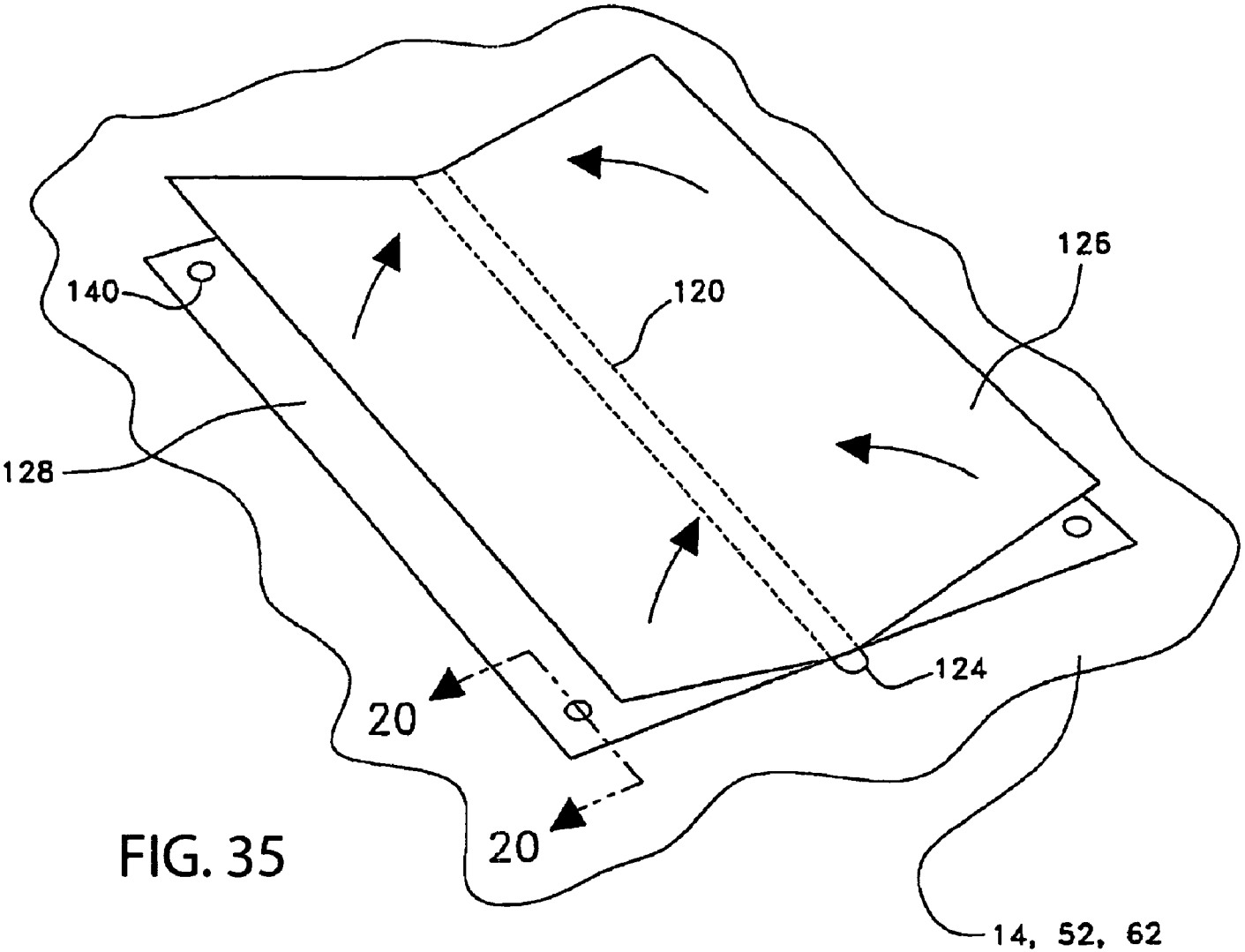
FIG. 35 is an enlarged, elevational, perspective view of a safety sheet and blanket in accordance with an embodiment of the present invention.
Figure 36A:
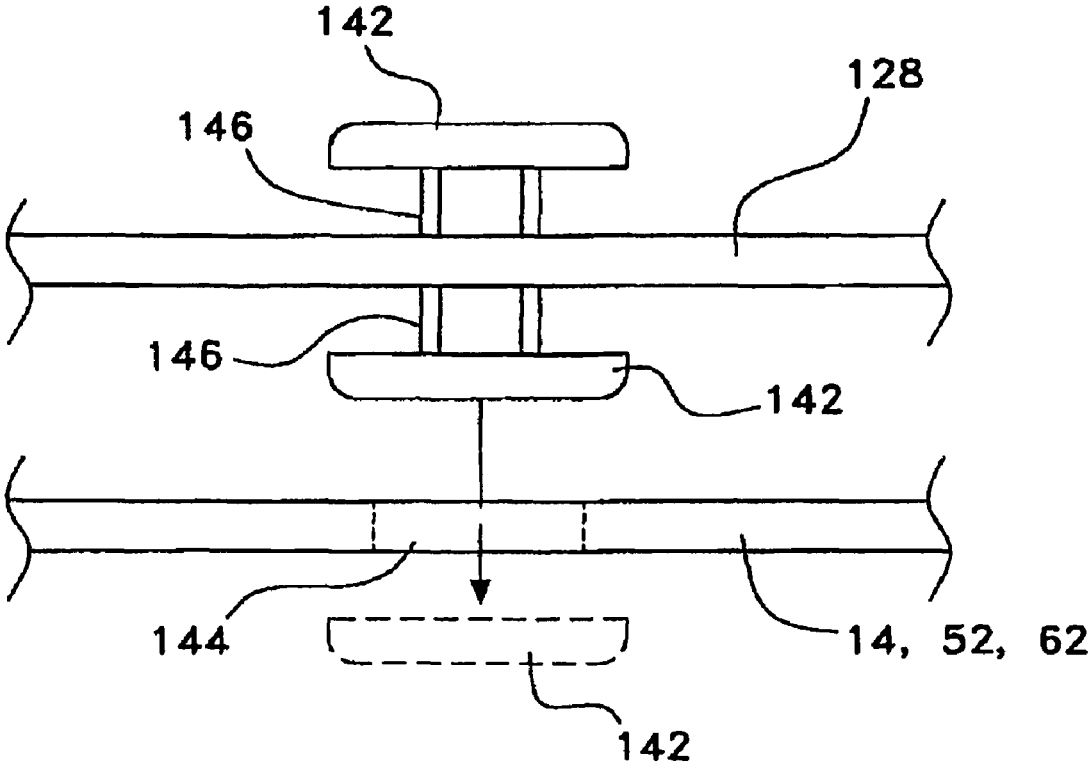
FIGS. 36A through 36D are cross-sectional views along 20-20 of FIG. 35.

According to the features of the invention, the safety sheet and blanket may have removability (without sacrificing the safety of the infant when wrapped therein). In this regard, a safety sheet and detachable blanket is shown in FIGS. 29-36D. The safety sheet and detachable blanket, referring to FIGS. 29, and 30, correspond to FIG. 18. The safety sheet and detachable blanket, referring to FIGS. 32, and 33, correspond to FIG. 22. The safety sheet and detachable blanket, referring to FIG. 34, corresponds to FIG. 25. FIGS. 35-36D further illustrate the detachable blanket with respect to FIGS. 30, and 33.

Figure 29:
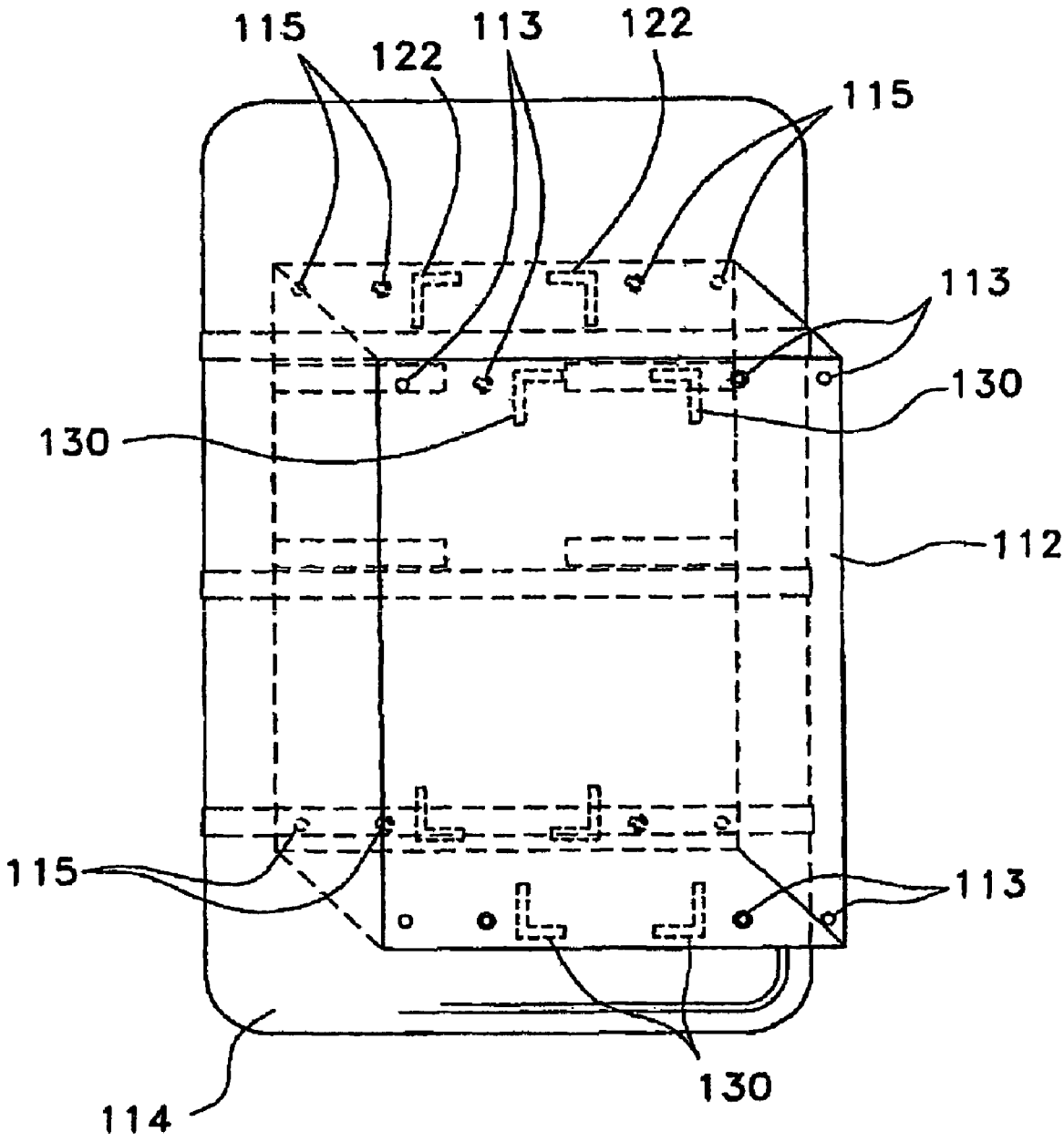
FIGS. 29 and 30 are top views of a safety sheet and blanket in accordance with an embodiment of the present invention.
Figure 32:
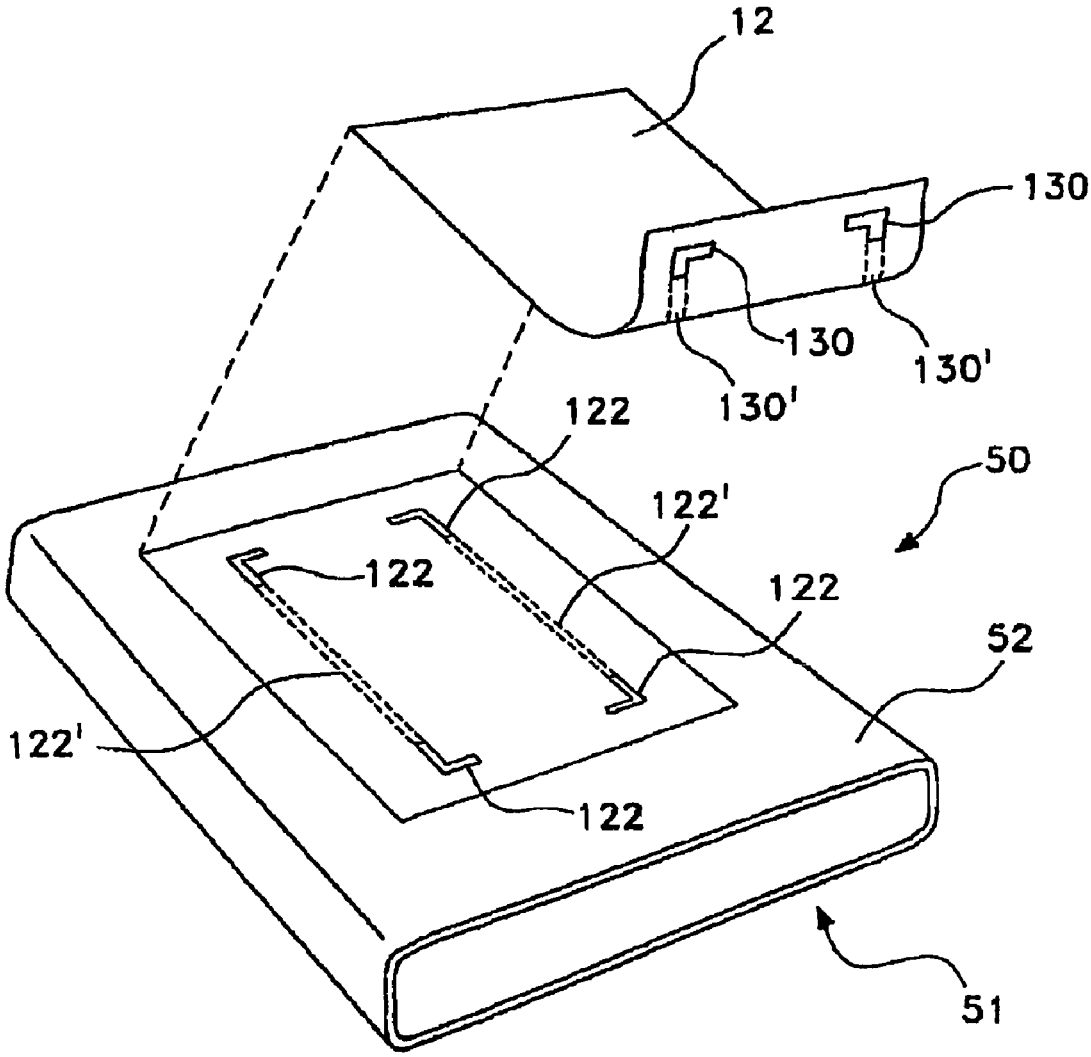
FIGS. 32 and 33 are exploded perspective views of a safety sheet and blanket in accordance with another embodiment of the present invention.
Figure 34:
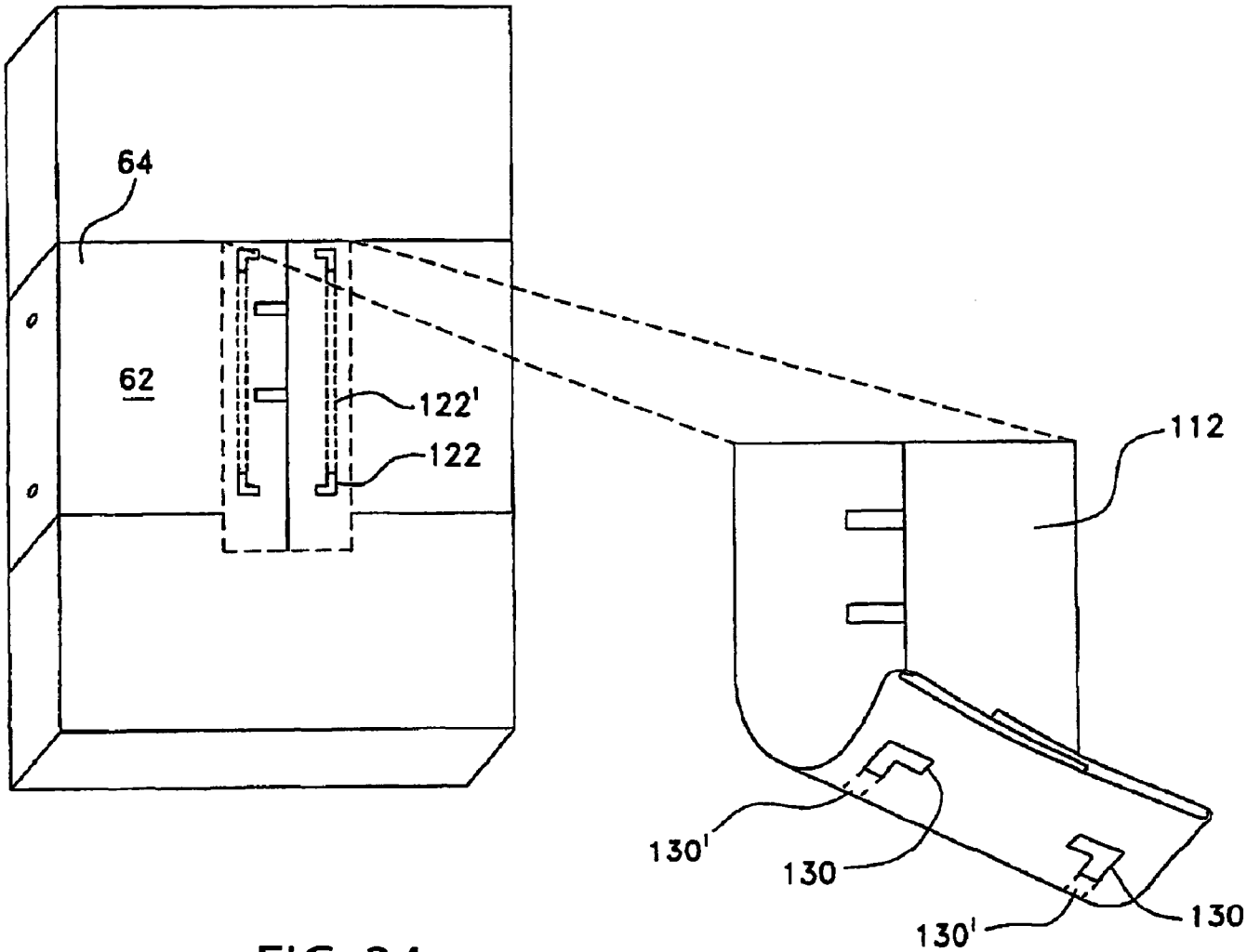
FIG. 34 is an exploded view of a safety sheet and blanket, similar to FIG. 25, in accordance with an embodiment of the present invention.

Referring to FIGS. 29, 32, and 34, a safety sheet and detachable blanket is shown in general. With respect to FIG. 29, the sheet 114 is provided with the detachable blanket 112, the features of detachable blanket 112 are the same as blanket 12 of FIG. 18, however the bottom of blanket 112 is provided with a first portion of a mating fastener 130, for engaging the corresponding second portion of the mating fastener 122. In this arrangement, the mating fastener portions 130, 122 provide the blanket 112 with a convenience element, for example, allowing the blanket 112 to be removed for laundering when soiled. The mating fasteners portions 130, 122 are, for example, hook and loop type fasteners (i.e., Velcro®).

The fastener portions 130, 122 are shown as being L-shaped however, it is within the purview of the invention to provide the fasteners with several other arrangements. As seen in FIG. 29, fasteners 130', 122' (in phantom) illustrate an arrangement having a pair of elongated strips attached to the bottom of the detachable blanket 112, and the top of the sheet 14, respectively. Although, the mating portions of fasteners 130, 122 (130', 122') are shown in particular arrangement, it is understood that any arrangement, and location of the fasteners 130, 122 (130', 122') so as the function of allowing an infant to rest comfortably upon the blanket 112, and be wrapped in the blanket 112 (as seen in FIG. 17) in order to maintain the infant in the supine position. In addition, fasteners 113, 115, provide the same function of the fasteners 13, 15 of FIG. 18.

In FIG. 32, similar to FIG. 22, a cover 52, for a sleep surface, is shown having top and bottom surfaces. The top and bottom surfaces are joined together around the perimeter, so as to define an opening 51. The cover 52 envelopes the sleep surface, as discussed above, with respect to FIG. 22. The detachable blanket 12 is removably attached to the top surface of the cover 52 via mating fasteners 130, 122 (130', 122'), as discussed above with respect to FIG. 29. Although the sack 52 is shown having the opening 51 at one end thereof, it is well within the purview of this invention that the opening 51 extends either along the side, or across the bottom (e.g., a sham). In this feature, the majority of the bedding material is enveloped by the sack 52.

Referring to FIG. 34, similar to FIG. 25 and having corresponding components, a flat sheet 62 is shown, having a top surface 64. The top surface 64 is provided with the fastener portions 122 (122') for engaging the mating fastener portions 130 (130') the bottom surface of the detachable blanket 112. As discussed above, with respect to FIGS. 29, and 32, the mating fasteners 130, 122 (130', 122') are typically hook and loop type fasteners (i.e., Velcro®), however, any other suitable fasteners are useable so long as not to interfere with the comfort of the infant when wrapped and secured in the detachable blanket 112.

Turning to FIGS. 30, 31A, 31B and 33, an alternative variation of the present invention for providing a detachable safety blanket is illustrated. In these figures, as the case of FIGS. 13, 16, and 18 above, common corresponding elements have the same reference numerals.

Figure 31A:
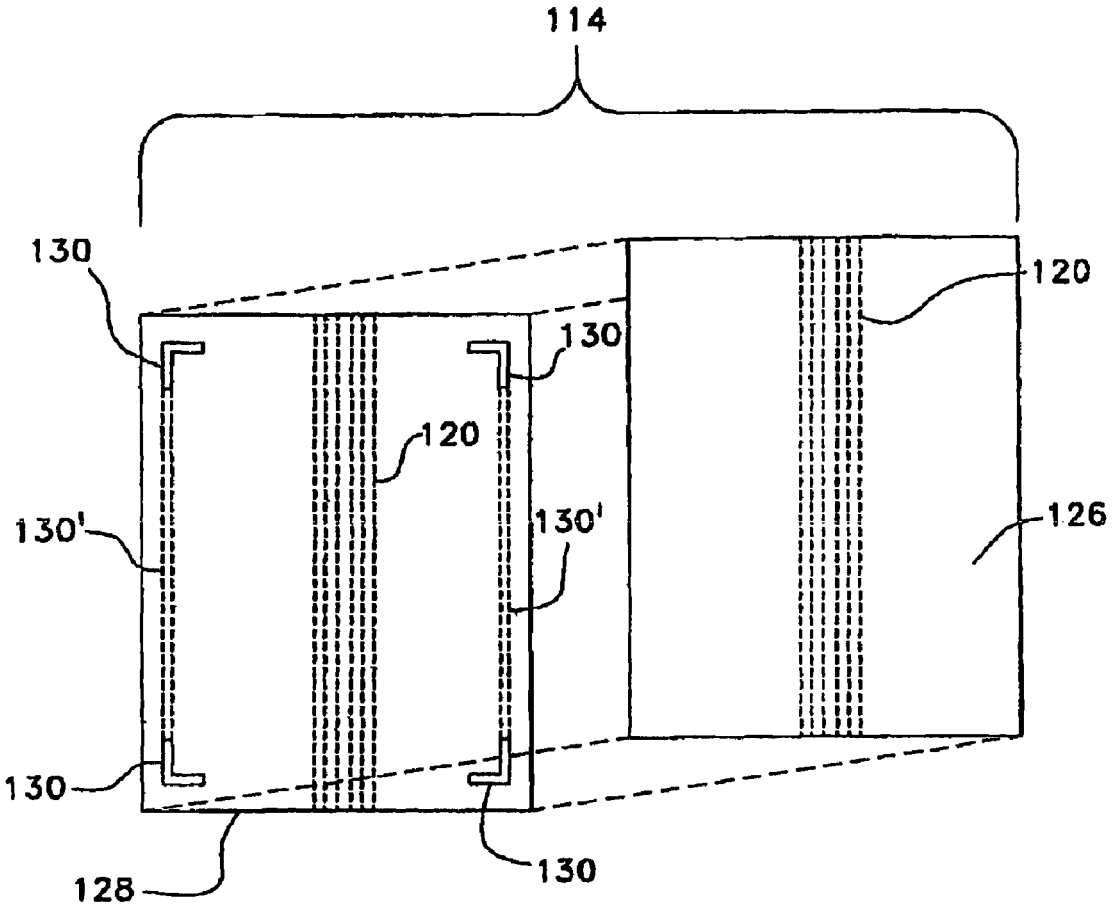
FIGS. 31A and B are exploded perspective views of the sheet and blanket and sheet member of FIG. 30.
Figure 31B:
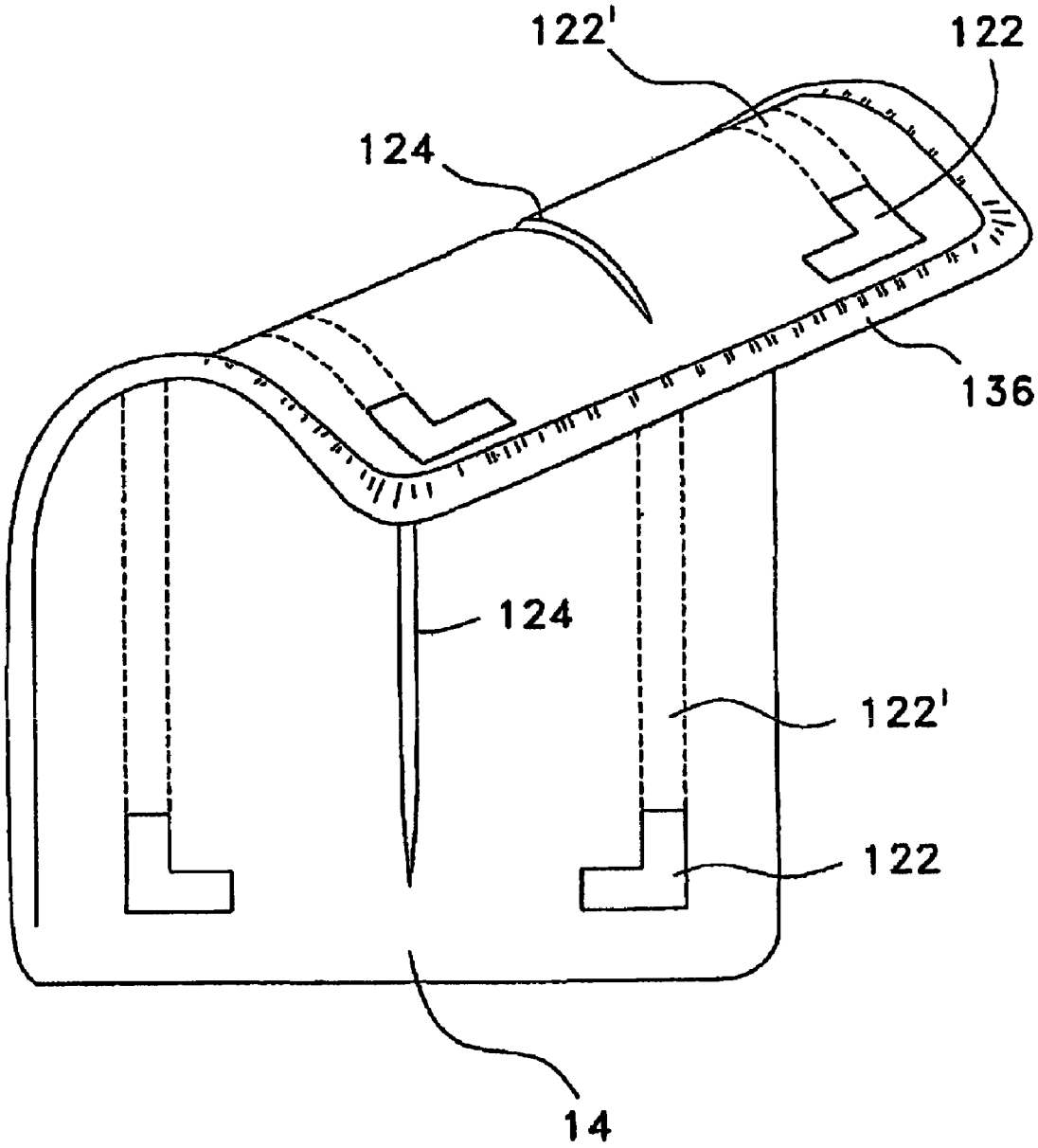

FIG. 14, shows a detachable blanket 126, as in FIG. 29, with an added sheet material 128 permanently secured to the bottom of detachable blanket 126. FIGS. 31A and 31B are exploded presentations of FIG. 32, to more clearly illustrate this aspect of the instant invention. The detachable blanket 126 is shown attached to the sheet material 128 via stitching 120. Stitching 120 is the same as the stitching 20 of FIG. 18. Although, the stitching 120 is shown along the midline of the blanket 126, it is understood that the stitching may be disposed in any manner so as to allow the blanket 126 to wrap and secure an infant therein. The sheet material 128 is selected any fabric type, and has the fasteners 130 disposed thereon. It is desired to have the detachable blanket 126 to be as versatile as possible. In that manner, the fastener portions 130 are disposed about the sheet material 128, and on both the upper and lower surfaces thereof.

Sheet 14, likewise has the mating fastener portions 122 disposed thereon in a mirror image fashion to the sheet material 128. In addition, the fastener portions 122 are likewise disposed on both the upper and lower surfaces of the sheet 14. Sheet 14 is further provided with an opening 124, such as slit. The opening 124 allows the sheet material 128 to be maneuvered to therethrough. In this manner, the fastener portions 130 on the upper surface thereof may engage the corresponding fastener portions 122 on the lower surface of the sheet 14 (see FIG. 31B). The sheet 14 includes an optional elasticized perimeter 136, thus more commonly referred to as a fitted sheet form. The omission of the elasticized perimeter 136 would result in the sheet 14 being a standard flat sheet form. In addition, the fastener portions 122 on lower surface allow for the reversibility of the sheet 14 on the sleep surface (not shown) in each of the flat and fitted forms.

Figure 30:
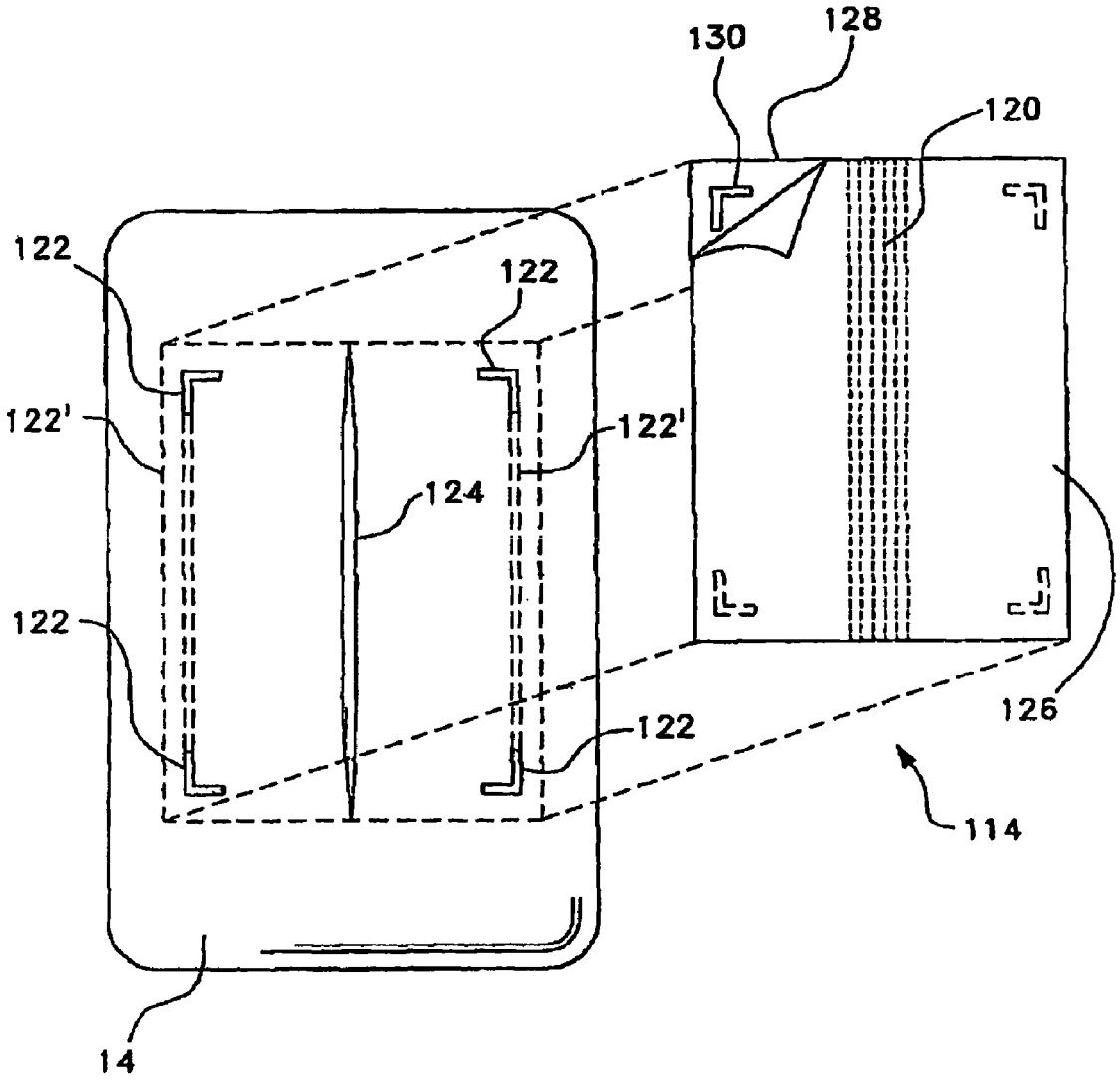

In addition, as in FIG. 29, the disposition of the mating fastener portions 130, 122 are not limited the arrangement shown in FIG. 30, but any suitable arrangement is well within the scope of the invention. As such, mating fastener portions 130', 122' are likewise illustrated as elongated strips. The mirroring of fastener portions 122' to that of 130' is the same as for the fastener portions 130, 122. The mating fastener portions 130, 122 (130', 122') are preferably hook and loop fasteners (i.e., Velcro®), however, any suitable fastener is useable in this arrangement so long as the disposition thereof does not create any discomfort to the infant wrapped in the blanket 112.

Figure 33:
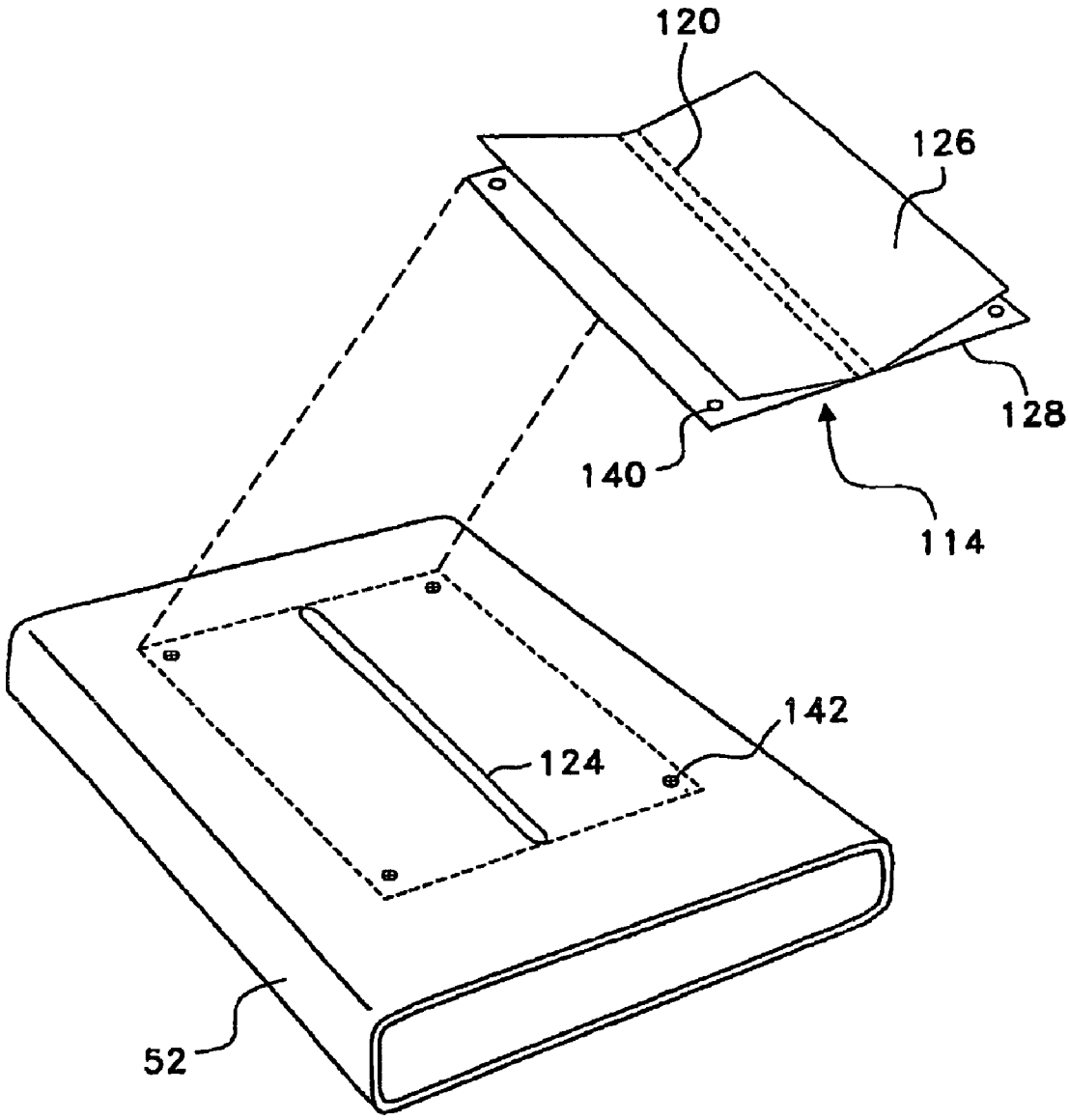

FIG. 33, combines the structures of sheet 52 from FIG. 22 and the detachable blanket 114 of FIG. 30. As shown in FIG. 32 above, a sheet, sack, or cover 52, for a sleep surface, is shown having top and bottom surfaces. The top and bottom surfaces are joined together around the perimeter, so as to define an open end 51. The cover 52 envelopes the sleep surface, as discussed above, with respect to FIG. 22 the cover 52 includes the opening 124 in the top surface thereof. Although the cover 52 is shown having the opening 51 at one end thereof, it is well within the purview of this invention that the opening 51 extends either along the side, or across the bottom (e.g., a sham). In this feature, the majority of the bedding material is enveloped by the cover 52.

The detachable blanket 126 is shown attached to the sheet material 128 via stitching 120. Stitching 120 is the same as the stitching 20 of FIG. 18. Although, the stitching 120 is shown along a midline of the blanket 126, it is understood that the stitching may be disposed in any manner so as to allow the blanket 126 to wrap and secure an infant therein. The sheet material 128 is selected any fabric type, and has the fasteners 130 disposed thereon. It is desired to have the detachable blanket 126 to be as versatile as possible. In that manner, the fastener portions 140 are disposed about the sheet material 128, and on both the upper and lower surfaces thereof.

Sheet 52, likewise has the mating fastener portions 142 disposed thereon in a mirror image fashion to the sheet material 128. In addition, the fastener portions 142 are likewise disposed on both the upper and lower surfaces of the sheet 52. Sheet 52 is further provided with the opening 124. The opening 124 allows the sheet material 128 to be maneuvered to therethrough. In this manner, the fastener portions 140 on the upper surface thereof may engage the corresponding fastener portions 142 on the lower surface of the sheet 52 (e.g., see FIG. 31B).

FIG. 35 is a partial enlarged portion of any of FIGS. 30, 31A and 31B, and 33, illustrating the mating fastener arrangement according to the present invention. The detachable blanket 126 coupled to a sheet portion 128 via stitching 120. The attachment allows at least two sides of the blanket 126 that are wrapped around the infant (as indicated by the arrows), note FIG. 35. The detachable safety blanket 126 is securely and removably attached to the sheet (or sleep surface cover) 14, 52, 62, via a mating fastener arrangement 140 between the sheet material portion 128 and the sheet 14, 52, 62. The mating fastener arrangement 140, includes the hook and loop type fasteners 130, 122 (130', 122') discussed above, or any other suitable mating fastener types. FIGS. 36A, 36B, 36C, 36D, are cross-sectional views of a few examples of the myriad of fastener types 140 suitably used to secure the detachable blanket 126 to the sheet 14, 52, 62.

The sheet 14, 52, 62 includes a opening 124 for positioning the sheet material 128, so as to extend therethrough, as discuss above. Sheet material 128 has a one portion of the fastener 140, and the sheet 14, 52, 62 has the other portion. FIG. 36A illustrates a first example of the fastener types 140. Sheet material 128 has buttons 142 attached to the upper and lower surfaces thereof via coupling material 146 (e.g. thread). Sheet 14, 52, 62 includes a button hole 144 defined therethrough. In this arrangement, the sheet material 128 is disposable on the either upper or lower surface of the sheet 14, 52, 62, and is secured by passing a button 142 through the buttonhole 144.

Figure 36B:
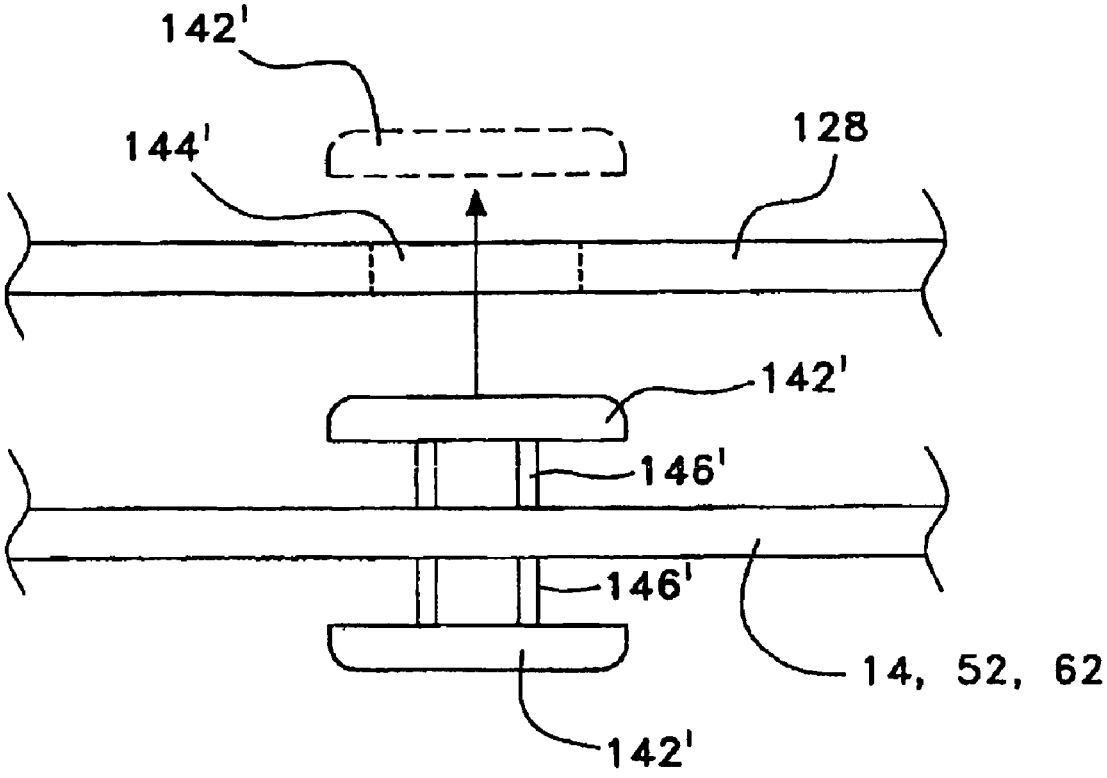

FIG. 36B illustrates another example of the fastener types 140. Sheet material 128 has a button hole 144' defined therethrough. Sheet 14, 52, 62 has buttons 142' attached to the upper and lower surfaces thereof via coupling material 146' (e.g. thread). In this arrangement, the sheet material 128 is disposable on the either upper or lower surface of the sheet 14, 52, 62, and is secured by passing a button 142' through the button hole 144'.

Figure 36C:
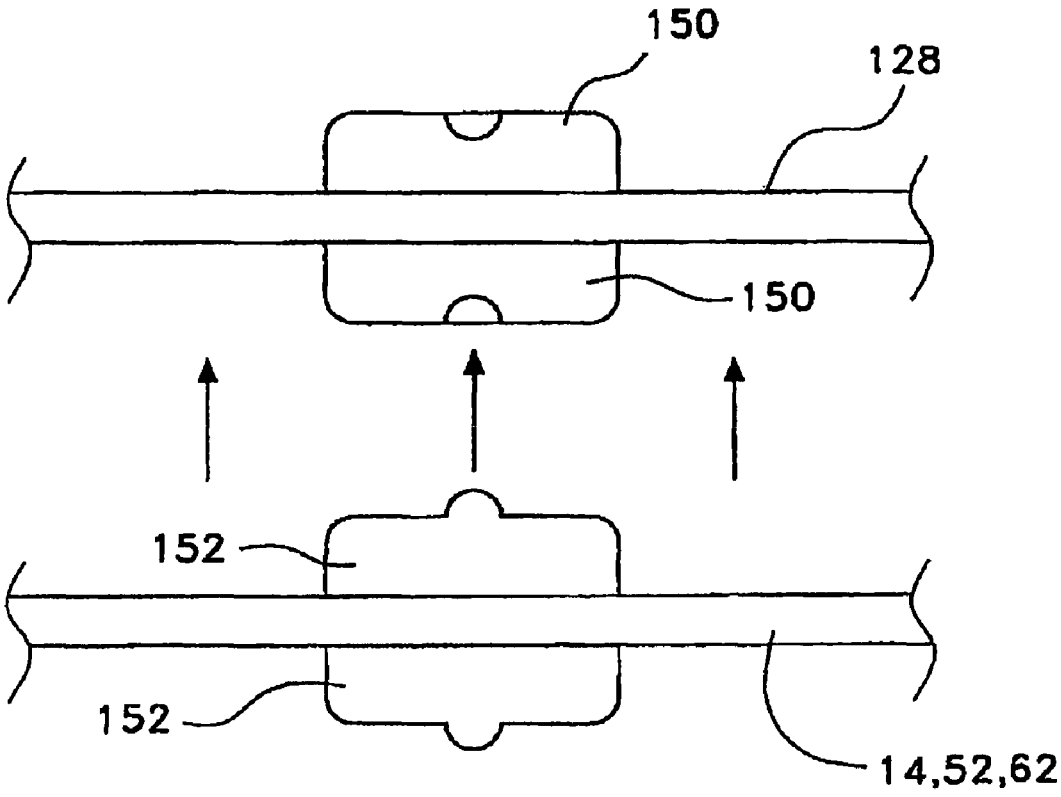
Figure 36D:
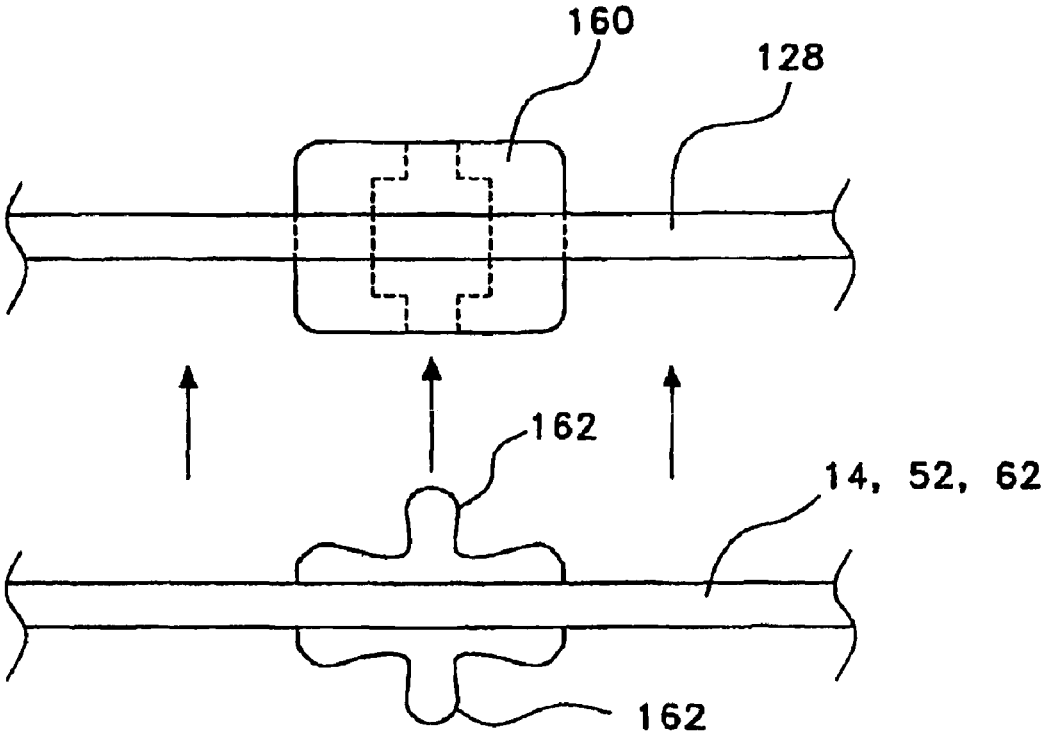

FIG. 36C illustrates another example of the fastener types 140. Sheet material 128 has a first part of a snap fastener 150 attached to the upper and lower surfaces thereof. Sheet 14, 52, 62 has the other part of the snap fastener 152 attached to the upper and lower surfaces thereof. In this arrangement, the sheet material 128 is disposable on the either upper or lower surface of the sheet 14, 52, 62, and is secured by mating the first and second parts of the snap fasteners 150, 152 together. It is understood that either part of the snap fastener 140 of FIG. 36C is disposable on the sheet material 128, so long as the mating part is disposed in a mirrored fashion on the sheet 14, 52, 62. FIG. 36D illustrates another example of the fastener types 140. Sheet material 128 has a grommet 160 attached thereon, forming a reinforced aperture in the sheet material 128. Sheet 14, 52, 62 has resilient tongue member 162 attached to the upper and lower surfaces thereof In this arrangement, the sheet material 128 is disposable on the either upper or lower surface of the sheet 14, 52, 62, and is secured by mating the resilient tongue member 162 with the grommet 160 together. It is understood that either the grommet 160 or the resilient tongue member 162 of the fastener 140 of FIG. 36D is disposable on the sheet material 128, so long as the mating part is disposed in a mirrored fashion on the sheet 14, 52, 62. In addition, it is well within the purview of the instant invention that resilient tongue member 162 is may be any mechanism the is capable of being coupled to a grommet so as the detachable blanket 126 is secured to the sheet 14, 52, 62 without interfering with the comfort of the infant wrapped in the detachable blanket 126.

It is well within the abilities of one skilled in the art to alter the shape and/or size of the fitted sheet or mattress attachment sheet and blanket to fit a variety of different infant sleeping devices such as cribs, bassinets, incubators and playpens. The sheet and the blanket may be made from any suitable material, including cotton, wool, polyester, silk, Lycra®, and nylon. Likewise, any other variant of mating fastener for securing the detachable blanket to the sheet or sleep surface cover is consider within the scope of the appended claims of the invention.

It is to be understood that the present invention is not limited to the arrangements described above, but encompasses any and all arrangements within the scope of the following claims.

We claim:

1. A swaddle blanket for attaching to a mattress attachment device, the swaddle blanket comprising:

a top end and a bottom end;

a pocket disposed at the bottom end and configured to enclose an infant's legs;

a first side configured to wrap over the infant in a first direction;

a second side configured to wrap over the infant and the first side in a second direction;

a fastener disposed on the second side and configured to secure the second side in place over the first side; and at least two attachment straps secured to a rear portion and spaced from a perimeter of the swaddle blanket, each attachment strap having an attachment position in which the attachment strap extends away from the swaddle blanket, and each attachment strap including a mating pair fastener.

2. The swaddle blanket of claim 1 further comprising a head rest at the top end.

3. The swaddle blanket of claim 1 wherein each of the first and second sides are in the form of wings extending from a central portion of the swaddle blanket.

4. The swaddle blanket of claim 1 further comprising at least one inner strap configured to wrap around the infant underneath the first and second sides.

5. The swaddle blanket of claim 4 wherein the at least one inner strap includes a right inner strap and a left inner strap, the right and left inner straps being attachable.

6. The swaddle blanket of claim 1 further comprising another fastener disposed at a bottom tip of the pocket and configured to hold a lower portion of the pocket in a folded position.

7. The swaddle blanket of claim 1 further comprising a compartment adjacent the rear portion and adapted to hold a pad.

8. The swaddle blanket of claim 7 further comprising the pad, wherein the pad has a teardrop shape.

9. The swaddle blanket of claim 1 wherein a depth of the pocket is adjustable.

10. A swaddle blanket comprising:

a top end and a bottom end;

a head rest at the top end;

a pocket secured and disposed at the bottom end and configured to enclose an infant's legs when the infant is disposed within the swaddle blanket;

a first side configured to wrap over the infant in a first direction;

a second side configured to wrap over both the infant and the first side in a second direction;

a pair of inner straps configured to wrap around the infant underneath the first and second sides, a fastener disposed on the second side and configured to secure the second side in place over the first side; and another fastener disposed at a bottom tip of the pocket and configured to hold a lower portion of the pocket in a folded position.

11. A swaddle blanket comprising:

a central portion configured to receive an infant, the central portion including a top end with a head section and a bottom end;

a pocket secured and disposed at the bottom end and configured to enclose an infant's legs when the infant is disposed within the swaddle blanket;

a first side extending from the central portion and configured to wrap over the infant in a first direction;

a first slot disposed between the head section and the first side, the first slot being configured to pass an arm of the infant therethrough;

a second side extending from the central portion opposite the first side and configured to wrap over both the infant and the first side in a second direction;

a second slot disposed between the head section and the second side, the second slot being configured to pass another arm of the infant therethrough; and a fastener disposed on the second side and configured to secure the second side in place over the first side.

12. The swaddle blanket of claim 11 wherein a portion of the head section and the first side overlap, and wherein a portion of the head section and the second side overlap.

13. The swaddle blanket of claim 12 wherein each slot includes a fastener pair operable to close the slot.

14. A swaddle blanket for an infant comprising:

a top end and a bottom end;

a pocket disposed at the bottom end and encloses the infant's legs;

a first side wrapping over the infant in a first direction;

a second side wrapping over both the infant and the first side in a second direction;

a pair of inner straps, spaced from the perimeter of the blanket, wrapping around the infant underneath the first and second sides; and a fastener disposed on the second side and configured to secure the second side in place over the first side.

15. A swaddle blanket for an infant comprising:

a top end and a bottom end;

a pocket disposed at the bottom end and encloses the infant's legs;

a first side wrapping over the infant in a first direction;

a second side wrapping over both the infant and the first side in a second direction;

a pair of inner straps wrapping around the infant underneath the first and second sides and enclosing only the infant's torso; and a fastener disposed on the second side and configured to secure the second side in place over the first side, wherein the pair of inner straps are spaced from the bottom end of the blanket.

* * * * *